US009792852B2

(12) United States Patent
Nakahata

(10) Patent No.: US 9,792,852 B2
(45) Date of Patent: Oct. 17, 2017

(54) SIGNAL PROCESSING METHOD, DISPLAY APPARATUS, AND ELECTRONIC APPARATUS

(71) Applicant: Sony Corporation, Tokyo (JP)

(72) Inventor: Yuji Nakahata, Tokyo (JP)

(73) Assignee: Sony Corporation, Tokyo (JP)

( * ) Notice: Subject to any disclaimer, the term of this patent is extended or adjusted under 35 U.S.C. 154(b) by 190 days.

(21) Appl. No.: 14/662,367

(22) Filed: Mar. 19, 2015

(65) Prior Publication Data

US 2015/0279280 A1 Oct. 1, 2015

(30) Foreign Application Priority Data

Mar. 31, 2014 (JP) ..... 2014-073802

(51) Int. Cl.
*G09G 3/32* (2016.01)
*G09G 3/3225* (2016.01)
*G09G 3/3266* (2016.01)

(52) U.S. Cl.
CPC ..... *G09G 3/3225* (2013.01); *G09G 3/3266* (2013.01); *G09G 2300/0452* (2013.01); *G09G 2300/0842* (2013.01); *G09G 2320/02* (2013.01); *G09G 2320/0242* (2013.01); *G09G 2320/0271* (2013.01); *G09G 2320/045* (2013.01); *G09G 2360/16* (2013.01)

(58) Field of Classification Search
None
See application file for complete search history.

(56) References Cited

U.S. PATENT DOCUMENTS 8,035,584 B2 * 10/2011 Jung ..... G09G 3/3233 315/169.3
8,232,987 B2 * 7/2012 Park ..... G09G 3/2007 345/204
8,319,711 B2 * 11/2012 Shirasaki ..... G09G 3/3233 345/77

(Continued)

FOREIGN PATENT DOCUMENTS

JP 2011-154237 8/2011
JP 2012-155953 8/2012

*Primary Examiner* — Antonio Xavier
(74) *Attorney, Agent, or Firm* — Michael Best & Friedrich LLP

(57) ABSTRACT

A signal processing method includes inputting image signals containing gradations of respective pixels of an image to be displayed. Corresponding gradations, which are the gradations contained in the input image signals and corresponding to respective common pixel circuits included in a plurality of common pixel circuits, are selected. The plurality of common pixel circuits is a plurality of predetermined pixel circuits among a plurality of pixel circuits each having a light-emitting element, the plurality of predetermined pixel circuits being commonly connected to a signal line, a plurality of signal voltages being output to the signal line sequentially and continuously, each signal voltage setting a light-emission luminance of the light-emitting element. On the basis of a plurality of corresponding gradations selected corresponding to the plurality of common pixel circuits, sizes of the respective signal voltages being output to the signal line sequentially and continuously are corrected.

12 Claims, 18 Drawing Sheets

(56) References Cited

U.S. PATENT DOCUMENTS

2002/0003542 A1* 1/2002 Tanaka ..... G09G 3/2033 345/581
2008/0100542 A1* 5/2008 Miller ..... G09G 3/3258 345/77
2008/0170004 A1* 7/2008 Jung ..... G09G 3/3233 345/76
2009/0109210 A1* 4/2009 Ito ..... G09G 3/3648 345/214
2011/0018787 A1* 1/2011 Nakamura ..... G09G 3/3233 345/76
2011/0141130 A1* 6/2011 Yagiura ..... G09G 3/003 345/589
2011/0181626 A1 7/2011 Toyomura et al.
2011/0279049 A1* 11/2011 Kawabe ..... G09G 3/3233 315/228
2012/0187425 A1 7/2012 Omoto
2013/0027383 A1* 1/2013 Odawara ..... G09G 3/3233 345/212
2014/0063079 A1* 3/2014 Lee ..... G09G 5/02 345/690
2014/0118228 A1* 5/2014 Kang ..... G09G 3/3233 345/77
2014/0320042 A1* 10/2014 Yamamoto ..... H05B 33/0896 315/294
2014/0361960 A1* 12/2014 Yamauchi ..... G09G 3/3233 345/76
2015/0077446 A1* 3/2015 Li ..... G09G 3/2022 345/690
2015/0097870 A1* 4/2015 Lee ..... G09G 3/2096 345/690
2015/0130858 A1* 5/2015 Ryu ..... G09G 3/3216 345/690
2015/0145851 A1* 5/2015 Takeda ..... G09G 3/3233 345/212
2016/0111044 A1* 4/2016 Kishi ..... G09G 3/3233 345/690
2016/0125796 A1* 5/2016 Ohara ..... G09G 3/30 345/211

* cited by examiner

Adjacent corresponding gradation input

Target corresponding gradation output

Target corresponding gradation input

| | 0 | 64 | 128 | ··· | 1023 |
|---|---|---|---|---|---|
| 0 | 0 | Value ≧ 64 | ↓ | | — |
| 64 | — | 64 | Value ≧ 128 | | — |
| 128 | — | Value ≦ 64 | 128 | | — |
| ··· | — | ↑ | Value ≦ 128 | ··· | — |
| 1023 | — | ↑ | ↑ | | 1023 |

Adjacent corresponding gradation input

Target corresponding gradation output

Target corresponding gradation input

| | 0 | 64 | 128 | ··· | 1023 |
|---|---|---|---|---|---|
| 0 | 0 | Value ≧ 64 | ↓ | | – |
| 64 | Value ≦ 0 | 64 | Value ≧ 128 | | – |
| 128 | ↑ | Value ≦ 64 | 128 | | – |
| ··· | ↑ | ↑ | Value ≦ 128 | ··· | – |
| 1023 | low | ↑ | ↑ | | 1023 |

Adjacent corresponding gradation input

Target corresponding gradation output

Target corresponding gradation input

| | 0 | 64 | 128 | ··· | 1023 |
|---|---|---|---|---|---|
| 0 | 0 | Value ≧ 64 | ↓ | | high |
| 64 | Value ≦ 0 | 64 | Value ≧ 128 | | ↓ |
| 128 | ↑ | Value ≦ 64 | 128 | | ↓ |
| ··· | ↑ | ↑ | Value ≦ 128 | ··· | Value ≧ 1023 |
| 1023 | low | ↑ | ↑ | | 1023 |

FIG.22A
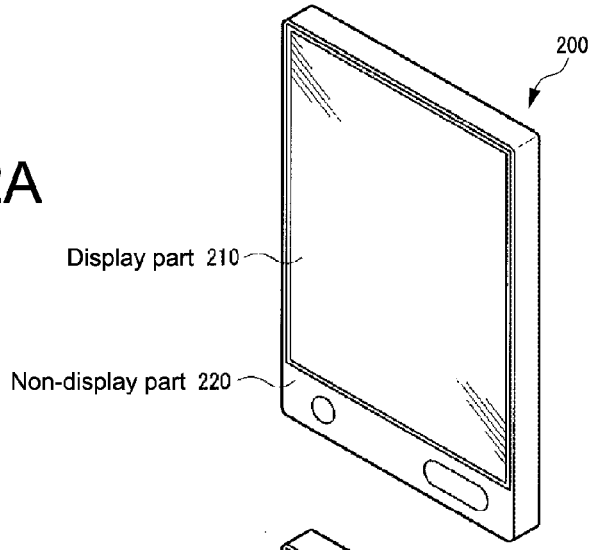
FIG.22B
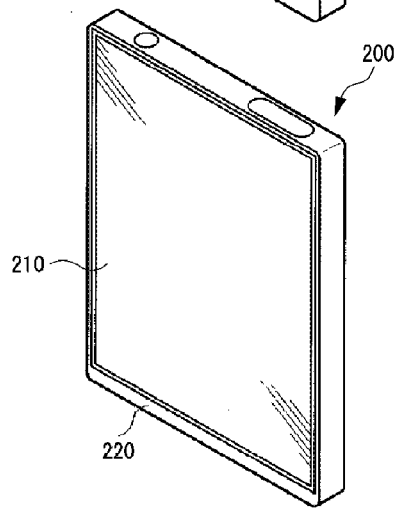
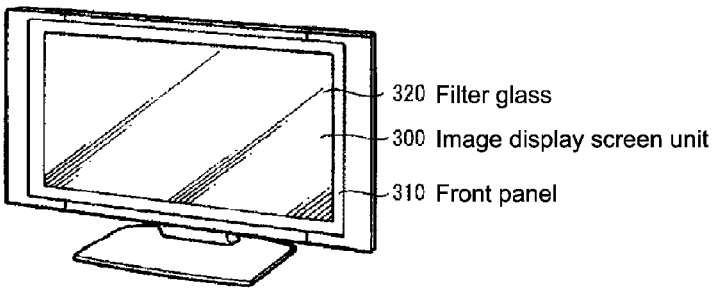
FIG.23

SIGNAL PROCESSING METHOD, DISPLAY APPARATUS, AND ELECTRONIC APPARATUS

CROSS REFERENCE TO RELATED APPLICATIONS

This application claims the benefit of Japanese Priority Patent Application JP 2014-073802 filed Mar. 31, 2014, the entire contents of which are incorporated herein by reference.

BACKGROUND

The present disclosure relates to signal processing methods, display apparatuses and electronic apparatuses, for displaying images.

From the past, as one kind of display apparatuses, there has been known a display apparatus that uses, as a light-emitting unit (light-emitting element) of a pixel, a so-called current-driven electro-optic element. In a current-driven electro-optic element, a light-emission luminance varies depending on an applied current. As a current-driven electro-optic element, an organic electroluminescence (EL) element has been known. The organic EL element utilizes electroluminescence (EL) of an organic material, and uses a phenomenon that an organic thin film emits light when an electric field is applied thereto.

An organic EL display apparatus, using the organic EL element as the light-emitting unit of the pixel, has the following features. The organic EL element can be driven by an applied voltage of 10 V or lower, so its power consumption is low. In addition, since the organic EL element is a self-luminous element, the display has a high level of image visibility compared to that of a liquid crystal display apparatus; and moreover, since it does not need a lighting member such as a backlight, it can be readily made lighter and thinner. Further, since a response speed of the organic EL element is very high, which may be about several μsec, it is not likely to cause a residual image when displaying a video image.

In an organic EL display apparatus disclosed in Japanese Patent Application Laid-open No. 2012-155953 (hereinafter referred to as Patent Document 1), as shown in FIG. 10 and the like, a metal wiring 90 is formed in the same layer with an anode electrode 211. The metal wiring 90 is electrically connected to an organic layer (charge-injection layer 214, connection layer 216 and 217), and is set to a lower potential than that of the anode electrode 211 in a state of not emitting light. Thus, a leak current flowing through the organic layer is prevented from flowing into the adjacent pixel side. As a result, it has become possible to inhibit light emission due to the leak current in adjacent pixels, and realize good color reproduction (color purity) (see Patent Document 1, paragraphs [0098] to [0105], etc.).

In an organic EL display apparatus disclosed in Japanese Patent Application Laid-open No. 2011-154237 (hereinafter referred to as Patent Document 2), as shown in FIG. 8 and the like, a plurality of horizontal lines is regarded as one unit; and in pixel circuits within the same unit, a threshold correction operation is performed at the same time. After the threshold correction operation is completed, a video signal voltage is input to each pixel circuit sequentially. The light is emitted with a luminance corresponding to each video signal voltage input. At this time, the input of the video signal voltage is performed in order from a beginning line to an ending line of a unit, and the same is performed in order from the ending line to the beginning line of an adjacent unit, in alternate order of the units. Thus, stripes occurring at the border between units can be cancelled; and this can increase the quality of the screen (see Patent Document 2, paragraphs [0062] to [0069], etc.).

SUMMARY

As described by Patent Documents 1 and 2, a variety of techniques to display images with high quality has been demanded.

In view of the circumstances as described above, it is desirable to provide a signal processing method, a display apparatus and an electronic apparatus which are able to display images with high quality.

According to an embodiment of the present disclosure, there is provided a signal processing method. The method includes inputting image signals containing gradations of respective pixels of an image to be displayed.

Corresponding gradations, which are the gradations contained in the input image signals and corresponding to respective common pixel circuits included in a plurality of common pixel circuits, are selected. The plurality of common pixel circuits is a plurality of predetermined pixel circuits among a plurality of pixel circuits each having a light-emitting element, the plurality of predetermined pixel circuits being commonly connected to a signal line, a plurality of signal voltages being output to the signal line sequentially and continuously, each signal voltage setting a light-emission luminance of the light-emitting element.

On the basis of a plurality of corresponding gradations selected corresponding to the plurality of common pixel circuits, sizes of the respective signal voltages in the plurality of signal voltages being output to the signal line sequentially and continuously are corrected.

This makes it possible to curb a problem that might occur due to the sequential and continuous output of the signal voltages to the signal line. As a result, it becomes possible to display images with high quality.

The step of correcting may include correcting levels of the respective corresponding gradations in the plurality of corresponding gradations, each on the basis of other corresponding gradations included in the plurality of corresponding gradations, and then generating the signal voltages according to the corrected corresponding gradations.

In such a manner, the sizes of the respective signal voltages may be corrected also by correcting the corresponding gradations.

The step of correcting may include generating the signal voltages according to the respective corresponding gradations in the plurality of corresponding gradations, and then correcting the sizes of the generated signal voltages.

In such a manner, the signal voltages according to the corresponding gradations may be adjusted.

The signal voltages according to the respective corresponding gradations in the plurality of corresponding gradations may be output to the signal line sequentially and continuously in an order of arrangement of the plurality of common pixel circuits. In this case, the step of correcting includes correcting a target corresponding gradation, on the basis of a corresponding gradation that corresponds to an adjacent common pixel circuit. The target corresponding gradation is a corresponding gradation in the corresponding gradations to be corrected. The adjacent common pixel circuit is adjacent to a common pixel circuit corresponding to the target corresponding gradation, among the common pixel circuits.

This may enable to sufficiently reduce an influence of the signal voltage output in the adjacent signal line.

The step of correcting may perform correction based on a magnitude relationship between the target corresponding gradation and an adjacent corresponding gradation, the adjacent corresponding gradation being the corresponding gradation that corresponds to the adjacent common pixel circuit.

This may enable to sufficiently reduce an influence of the adjacent corresponding gradation.

The step of correcting may include, if the adjacent corresponding gradation is higher than the target corresponding gradation, decreasing the target corresponding gradation, and if the adjacent corresponding gradation is lower than the target corresponding gradation, increasing the target corresponding gradation.

This may also enable to sufficiently reduce the influence of the adjacent corresponding gradation.

The step of correcting may, if the target corresponding gradation is a gradation of zero and the adjacent corresponding gradation is higher than the gradation of zero, allow the target corresponding gradation to be corrected to a gradation for correction. The gradation for correction is a gradation at which a correction voltage smaller than a zero signal voltage is generated. The zero signal voltage is a voltage which sets the light-emission luminance of the light-emitting element to zero.

By thus setting the correction voltage and setting the gradation for correction, it may allow the correction with high accuracy.

The step of correcting may include generating a plurality of summed corresponding gradations by adding a predetermined value of gradation to each of the corresponding gradations in the plurality of corresponding gradations being selected, and correcting levels of the respective summed corresponding gradations in the plurality of summed corresponding gradations being generated, each on the basis of other summed corresponding gradations included in the plurality of summed corresponding gradations. In this case, the signal processing method may further include generating the signal voltages according to gradations obtained from subtracting the predetermined value from the corrected summed corresponding gradations.

In such a manner, a predetermined value of gradation may be added when performing the correction. This may allow it to easily set the gradation for correction.

The lowest of the gradations may be a gradation in a range of from the gradation of zero to the predetermined value of gradation.

In such a manner, the gradation for correction may be easily set.

The plurality of pixel circuits may be arranged in a matrix, each pixel circuit having a drive transistor configured to apply a drive current depending on the signal voltage to the light-emitting element. In this case, the step of selecting may include selecting the corresponding gradations corresponding to the common pixel circuits in the plurality of common pixel circuits being commonly connected to the signal line and arranged in a vertical direction, the common pixel circuits being included in a plurality of horizontal pixel circuit groups at which a threshold correction is performed at a same timing. Each horizontal pixel circuit group includes pixel circuits commonly connected to a selecting line for selecting a pixel circuit to write the signal voltage, the pixel circuits being arranged in a horizontal direction. The threshold correction is to correct a gate-source voltage of the drive transistor based on a threshold voltage of the drive transistor.

Thus, by using this signal processing method when such a so-called simultaneous threshold cancel (STC) driving method is used, it becomes possible to display images with high quality.

According to another embodiment of the present disclosure, there is provided another signal processing method. The method includes inputting a first input image signal and a second input image signal. The first input image signal corresponds to a first pixel circuit connected to a predetermined signal line, and the second input image signal corresponds to a second pixel circuit adjacent to the first pixel circuit, the second pixel circuit being connected to the predetermined signal line.

A first signal voltage supplied to the first pixel circuit from the predetermined signal line in a first writing period is corrected based on the input second input image signal.

A second signal voltage supplied to the second pixel circuit from the predetermined signal line in a second writing period is corrected based on the input first input image signal.

This makes it possible to display images with high quality.

The first pixel circuit and the second pixel circuit may emit light having different colors from each other.

According to still another embodiment of the present disclosure, there is provided a display apparatus including an input part, a plurality of pixel circuits, a first output part, a selection part and a correction part.

The input part is configured to input image signals containing gradations of respective pixels of an image to be displayed.

The plurality of pixel circuits each has a light-emitting element.

The first output part is configured to output a plurality of signal voltages to a signal line sequentially and continuously, each signal voltage setting a light-emission luminance of the light-emitting element, the signal line being commonly connected to a plurality of predetermined pixel circuits among the plurality of pixel circuits.

The selection part is configured to select corresponding gradations which are the gradations contained in the input image signals and corresponding to respective common pixel circuits included in a plurality of common pixel circuits which is the plurality of predetermined pixel circuits.

The correction part is configured to correct sizes of the respective signal voltages in the plurality of signal voltages being output to the signal line sequentially and continuously, on the basis of a plurality of corresponding gradations selected corresponding to the plurality of common pixel circuits.

The plurality of pixel circuits may be arranged in a matrix, each pixel circuit having a drive transistor configured to apply a drive current depending on the signal voltage to the light-emitting element. In this case, the display apparatus may further include a second output part configured to output to a selecting line a selecting signal for selecting a pixel circuit to write the signal voltage, the selecting line being connected commonly to a plurality of horizontal pixel circuits among the plurality of pixel circuits, the horizontal pixel circuits being the pixel circuits arranged in a horizontal direction. Further, the plurality of common pixel circuits may be arranged in a vertical direction, and may be included in a plurality of horizontal pixel circuit groups at which a threshold correction is performed at a same timing. Each horizontal pixel circuit group includes the plurality of horizontal pixel circuits commonly connected to the selecting line. The threshold correction is to correct a gate-source voltage of the drive transistor based on a threshold voltage of the drive transistor.

According to still another embodiment of the present disclosure, there is provided an electronic apparatus including the display apparatus.

As described above, according to the present disclosure, it is possible to display images with high quality. Note that the effects described above are not limitative; and any effect described in the present disclosure may be produced.

These and other objects, features and advantages of the present disclosure will become more apparent in light of the following detailed description of best mode embodiment thereof, as illustrated in the accompanying drawings.

BRIEF DESCRIPTION OF DRAWINGS

FIGS. 22A and 22B are perspective views each showing an appearance of an application example of a display apparatus of the present disclosure; and FIG. 23 is a perspective view showing an appearance of another application example of a display apparatus of the present disclosure.

DETAILED DESCRIPTION OF EMBODIMENTS

Hereinafter, embodiments of the present disclosure will be described with reference to the drawings.

(Configuration of Display Apparatus)

Figure 1:
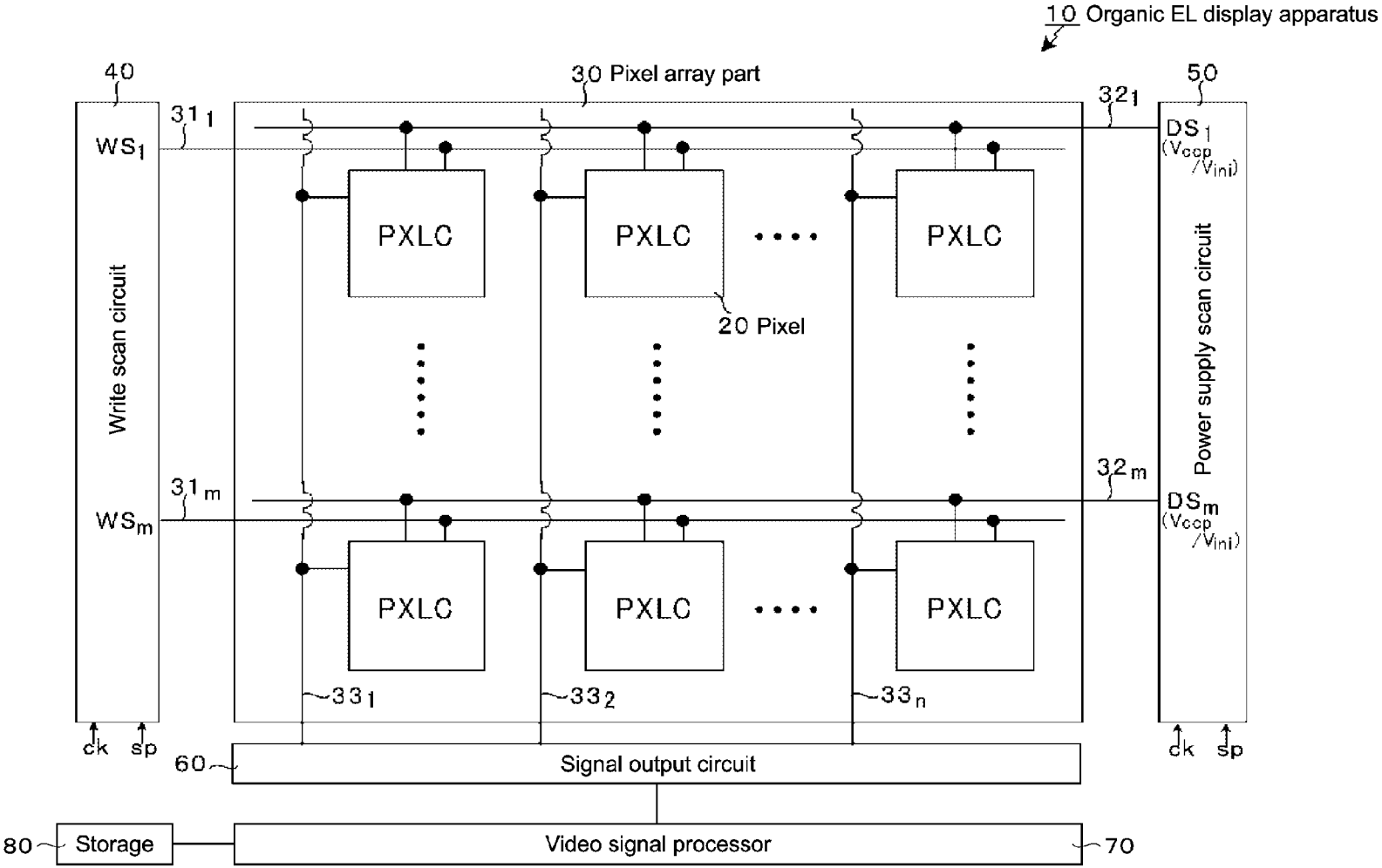
FIG. 1 is a schematic view showing a configuration example of a display apparatus according to an embodiment of the present disclosure.

FIG. 1 is a schematic view showing a configuration example of a display apparatus according to an embodiment of the present disclosure. In this embodiment, an active-matrix organic EL display apparatus is used as the display apparatus.

The active-matrix organic EL display apparatus controls a current flowing through an organic EL element as a current-driven light-emitting element, by using an active element provided within the same pixel as the organic EL element, that is, for example, by using an insulated-gate field-effect transistor. As a typical example of the insulated-gate field-effect transistor, a thin film transistor (TFT) may be used.

As shown in FIG. 1, an organic EL display apparatus 10 of this embodiment has a plurality of pixel circuits (hereinafter optionally referred to as "pixels 20"), the pixels 20 containing organic EL elements; a pixel array part 30 in which the pixels 20 are arranged two-dimensionally in rows and columns (a matrix); a drive circuit part arranged around the pixel array part 30; a video signal processor 70; and a storage 80.

The drive circuit part includes a write scan circuit 40, a power supply scan circuit 50, signal output circuit 60 and the like. The drive circuit part drives each pixel 20 of the pixel array part 30. The video signal processor 70 supplies signal voltages depending on image signals, to the signal output circuit 60.

In cases where the organic EL display apparatus 10 has a color-display enabled configuration, one pixel as a unit forming a color image (unit pixel) is made of a plurality of sub-pixels, and every one of the sub-pixels would be equivalent to the pixel 20 of FIG. 1. For example, one image is made up of three kinds of sub-pixels, which are the sub-pixels emitting red light (R), the sub-pixels emitting green light (G) and the sub-pixels emitting blue light (B).

Note that, however, one pixel may not be restricted to that made of a combination of three primary color sub-pixels of RGB. Additional one or more color sub-pixels may be included in one pixel having the three primary color sub-pixels as well. For example, a sub-pixel emitting white light (W) may be added, in order to enhance the luminance. At least one sub-pixel emitting a complementary color light may be added, in order to expand the color reproduction range.

Specific examples of configurations of the unit pixel including the plurality of sub-pixels include but are not limited to the following. The unit pixel may be made up by a plurality of pixels arranged as the sub-pixels, each pixel having a light-emitting layer emitting light of the corresponding color among the RGB and the like. Alternatively, the configuration in which a plurality of pixels each having a light-emitting layer emitting the same color light such as white light is arranged as the sub-pixels, and the colors of the emitted light are made different through color filters, may be employed. The description herein regarding the colors of the emitted light encompasses both, the case where the light-emitting layer itself emits the light having a different color from one another, and the case where the color filter converts the color of light to different colors.

In the pixel array part 30, with respect to the arrangement of the pixels 20 of m rows and n columns, there are provided scan lines $\mathbf{31}_1$ to $\mathbf{31}_m$, power supply lines $\mathbf{32}_1$ to $\mathbf{32}_m$ and signal lines $\mathbf{33}_1$ to $\mathbf{33}_n$. The scan lines $\mathbf{31}_1$ to $\mathbf{31}_m$, and the power supply lines $\mathbf{32}_1$ to $\mathbf{32}_m$, are wired along the row-direction (direction of the pixel array of each pixel row), for the respective pixel rows. The signal lines $\mathbf{33}_1$ to $\mathbf{33}_n$ are wired along the column-direction (direction of the pixel array of each pixel column), for the respective pixel columns. In this embodiment, the row-direction is the "horizontal" direction and the column-direction is the "vertical" direction.

Each of the scan lines $\mathbf{31}_1$ to $\mathbf{31}_m$ is connected to each output end of the corresponding row of the write scan circuit 40. Each of the power supply lines $\mathbf{32}_1$ to $\mathbf{32}_m$ is connected to each output end of the corresponding row of the power supply scan circuit 50. Each of the signal lines $\mathbf{33}_1$ to $\mathbf{33}_n$ is connected to each output end of the corresponding column of the signal output circuit 60.

The pixel array part 30 is typically formed on a transparent insulating substrate such as a glass substrate. The organic EL display apparatus 10 therefore has a flat-type panel structure. Each of the drive circuits of the pixels 20 in the pixel array part 30 can be formed by using an amorphous silicon thin film transistor (TFT) or a low-temperature poly-silicon TFT.

The write scan circuit 40 and the power supply scan circuit 50 each include a shift register circuit and the like. The shift register circuit sequentially shifts (transfers) a start pulse sp in synchronization with a clock pulse ck. In writing the signal voltage depending on a video signal to the pixels 20 in the pixel array part 30, the write scan circuit 40 sequentially supplies write scan signals WS ($WS_1$ to $WS_m$) to the scan lines 31 ($\mathbf{31}_1$ to $\mathbf{31}_m$). Thus, the pixels 20 in the pixel array part 30 are sequentially scanned on a row-by-row basis (line-sequential scanning).

In this embodiment, the write scan circuit 40 serves as a second output part which outputs to a selecting line (each scan line 31 ($\mathbf{31}_1$ to $\mathbf{31}_m$)) a selecting signal (each write scan signal WS ($WS_1$ to $WS_m$)) for selecting a pixel circuit to write the signal voltage, the selecting line being connected commonly to a plurality of horizontal pixel circuits (hereinafter optionally referred to as "horizontal pixels") among the plurality of pixel circuits, the horizontal pixel circuits being the pixel circuits arranged in a horizontal direction.

In synchronization with the line-sequential scanning by the write scan circuit 40, the power supply scan circuit 50 supplies, to the power supply lines 32 ($\mathbf{32}_1$ to $\mathbf{32}_m$), power potentials DS ($DS_1$ to $DS_m$) each of which can be switched between a first power potential $V_{ccp}$ and a second power potential $V_{ini}$ lower than the first power potential $V_{ccp}$. As will be described later, with the switching of $V_{ccp}/V_{ini}$ of each power potential DS, light-emission/non-light-emission of the pixels 20 would be controlled.

The signal output circuit 60 properly selects and outputs either one of: the signal voltage depending on the video signal (hereinafter, optionally, simply referred to as "signal voltage") $V_{sig}$, the video signal being supplied from the video signal processor 70; and a reference voltage $V_{ofs}$. The reference voltage $V_{ofs}$ described here is a potential which serves as a reference for the signal voltage $V_{sig}$ for the video signal (for example, the potential corresponding to black level of the video signal), and is used for threshold correction processing which will be described later.

The signal voltage $V_{sig}$/reference voltage $V_{ofs}$ output from the signal output circuit 60 is written to the pixels 20 via the signal lines 33 ($\mathbf{33}_1$ to $\mathbf{33}_n$) in units of the selected pixel rows, by the scanning by the write scan circuit 40. That is, the signal output circuit 60 employs a driving form of line-sequential writing in which the signal voltage $V_{sig}$ is written in units of rows (lines).

The video signal processor 70 is capable of performing predetermined processing such as gamma correction, on a video signal input from the outside or the like. For example, as a digital video signal, a plurality of image signals corresponding to respective frames included in a plurality of consecutive frames may be input. Each image signal is a signal containing information of a gradation of the corresponding pixel in the pixels of a rendered image (for example, a frame). Alternatively, an analog video signal may be input. In this case, the video signal may be properly sampled by the video signal processor 70, to generate the image signal for every frame.

On the basis of the image signals of the respective frames, the video signal processor 70 generates the signal voltages $V_{sig}$ for rendering the frames. The signal voltage $V_{sig}$ is generated for every pixel 20, and is supplied to the signal output circuit 60 at a predetermined timing to render the frame. Herein, the signal voltage depending on the video signal is equivalent to the signal voltage depending on the image signal of its corresponding frame.

In this embodiment, a signal processing method of the present disclosure is performed by the video signal processor 70. Specifically, in the pixels 20, gradations in the image signals are corrected as appropriate. Further, the signal voltages $V_{sig}$ are generated according to the corrected gradations.

The storage 80 includes, for example, read-only memory (ROM), a hard disk drive (HDD), and the like. The storage 80 functions as frame memory and stores a lookup table (LUT) to be used for correcting the gradations, which will be described later.

Figure 2:
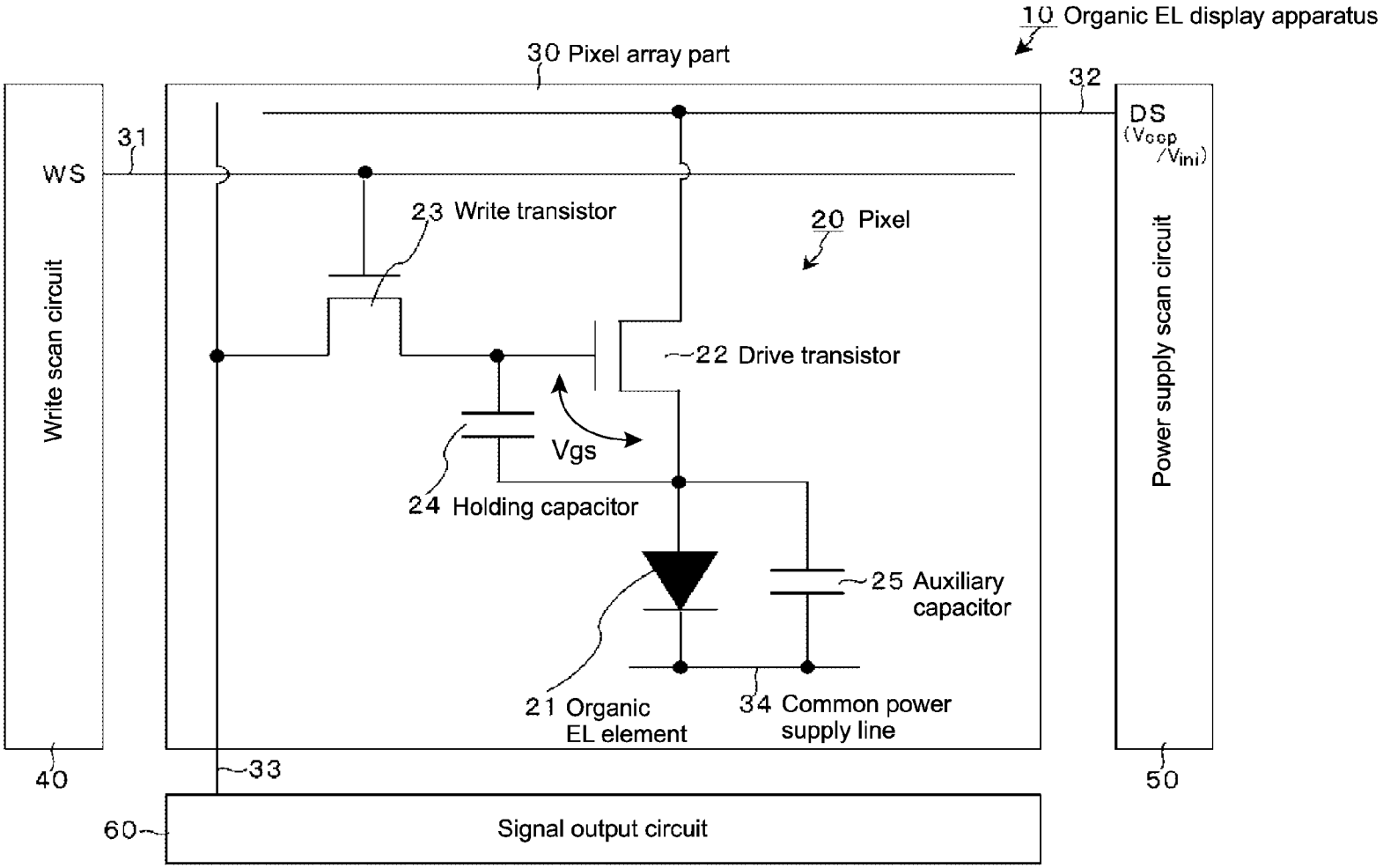
FIG. 2 is a circuit diagram illustrating an example of a detailed circuit configuration of a pixel (pixel circuit)

FIG. 2 is a circuit diagram illustrating an example of a detailed circuit configuration of the pixel (pixel circuit) 20. A light-emitting unit of the pixel 20 is made up of an organic EL element 21, which is a current-driven light-emitting element in which a light-emission luminance (light-emission gradation) varies depending on a current flowing through the device.

As shown in FIG. 2, the pixel 20 has the organic EL element 21, and a drive circuit which drives the organic EL element 21 by allowing the current to flow through the organic EL element 21. Typically, the organic EL element 21 has a structure in which an anode electrode, an organic layer and a cathode electrode are laminated in order.

The drive circuit for driving the organic EL element 21 includes a drive transistor 22, a write transistor 23, a holding capacitor 24 and an auxiliary capacitor 25. As the drive transistor 22 and the write transistor 23, for example, N-channel TFTs may be used. The combination of the conductivity types, or the like, of the drive transistor 22 and the write transistor 23 illustrated here is merely one example, and the combination is not limited thereto.

One electrode (source/drain electrode) of the drive transistor 22 is connected to the anode electrode of the organic EL element 21, and the other electrode (drain/source electrode) of the drive transistor 22 is connected to the power supply line 32 ($\mathbf{32}_1$ to $\mathbf{32}_m$).

One electrode (source/drain electrode) of the write transistor 23 is connected to the signal line 33 ($\mathbf{33}_1$ to $\mathbf{33}_n$), and the other electrode (drain/source electrode) of the write transistor 23 is connected to a gate electrode of the drive transistor 22. A gate electrode of the write transistor 23 is connected to the scan line 31 ($\mathbf{31}_1$ to $\mathbf{31}_m$).

Regarding the drive transistor 22 and the write transistor 23, "one electrode" represents a metal wiring electrically-connected to a source/drain region, while "the other electrode" represents a metal wiring electrically-connected to a drain/source region. In addition, depending upon the potential relationship between one electrode and the other electrode, one electrode may be a source electrode or drain electrode; while the other electrode may be a drain electrode or source electrode.

One electrode of the holding capacitor 24 is connected to the gate electrode of the drive transistor 22, and the other electrode of the holding capacitor 24 is connected to "the other electrode" of the drive transistor 22 and to the anode electrode of the organic EL element 21.

One electrode of the auxiliary capacitor 25 is connected to the anode electrode of the organic EL element 21, and the other electrode of the auxiliary capacitor 25 is connected to a common power supply line 34. The auxiliary capacitor 25 is provided as necessary, for the purpose of compensating for a shortage of the capacity of the organic EL element 21 and improving the write gain of the signal voltage with respect to the holding capacitor 24. Note that the above-mentioned other electrode of the auxiliary capacitor 25 may be connected to a fixed potential node, other than the common power supply line 34.

In the pixel 20 having such a configuration, the write transistor 23 enters a conductive state in response to a High-active scan signal WS applied to the gate electrode thereof from the write scan circuit 40 via the scan line 31. This allows the write transistor 23 to sample the signal voltage $V_{sig}$ or the reference voltage $V_{ofs}$ corresponding to the video signal that is supplied from the signal output circuit 60 via the signal line 33, and writes the sampled voltage in the pixel 20. The written signal voltage $V_{sig}$ or reference voltage $V_{ofs}$ is applied to the gate electrode of the drive transistor and held in the holding capacitor 24.

When the power potential DS of the power supply line ($\mathbf{32}_1$ to $\mathbf{32}_m$) is at the first power potential $V_{ccp}$, the drive transistor 22 operates in a saturated region, with one electrode thereof serving as a drain electrode and the other electrode thereof as a source electrode. This allows the drive transistor 22 to, upon receiving a current supplied from the power supply line 32, supply a drive current to the organic EL element 21. A current value of the drive current is a value dependent upon the signal voltage $V_{sig}$ held in the holding capacitor 24. As a result, the organic EL element 21 emits light with a gradation dependent upon the video signal.

When the power potential DS is switched from the first power potential $V_{ccp}$ to the second power potential $V_{ini}$, the drive transistor 22 operates as a switching transistor, with one electrode thereof serving as a source electrode and the other electrode thereof as a drain electrode. As a result, the drive transistor 22 stops the supply of the drive current to the organic EL element 21, thereby putting the organic EL element 21 in a non-emitting state. That is, the drive transistor 22 also has a function of a transistor for controlling the light-emission/non-light-emission of the organic EL element 21.

With the switching operation of the drive transistor 22, it becomes possible to set a period in which the organic EL element 21 is in a non-light-emitting state (non-light emission-period), and to control the ratio (duty) of the light-emission period and the non-light-emission period of the organic EL element 21. With the duty control, it is possible to reduce the after-image blur caused due to the light emission of a pixel over one display-frame period. Thus, it makes it possible to improve image quality, especially of videos.

Regarding the first and second power potentials $V_{ccp}$ and $V_{ini}$ selectively supplied from the power supply scan circuit 50 via the power supply line 32, the first power potential $V_{ccp}$ is a power potential for supplying, to the drive transistor 22, a drive current that causes the organic EL element 21 to drive and emit light. On the other hand, the second power potential $V_{ini}$ is a power potential for applying a reverse bias to the organic EL element 21. The second power potential $V_{ini}$ is set to a potential lower than the reference voltage $V_{ofs}$. For example, under the definition that a threshold voltage of the drive transistor 22 is $V_{th}$, the second power potential $V_{ini}$ is set to a potential sufficiently lower than $V_{ofs}-V_{th}$.

(Basic Circuit Operation)

A basic circuit operation of the organic EL display apparatus 10 having the configuration described above will be described with reference to a timing waveform chart of FIG. 3. In the timing waveform chart of FIG. 3, changes in the respective potentials of the following are shown: the potential (write scan signal) WS of the scan line 31; the potential (power potential) DS of the power supply line 32; the potential ($V_{sig}/V_{ofs}$) of the signal line 33); and, a gate potential $V_g$ and a source potential $V_s$ of the drive transistor 22.

Figure 3:
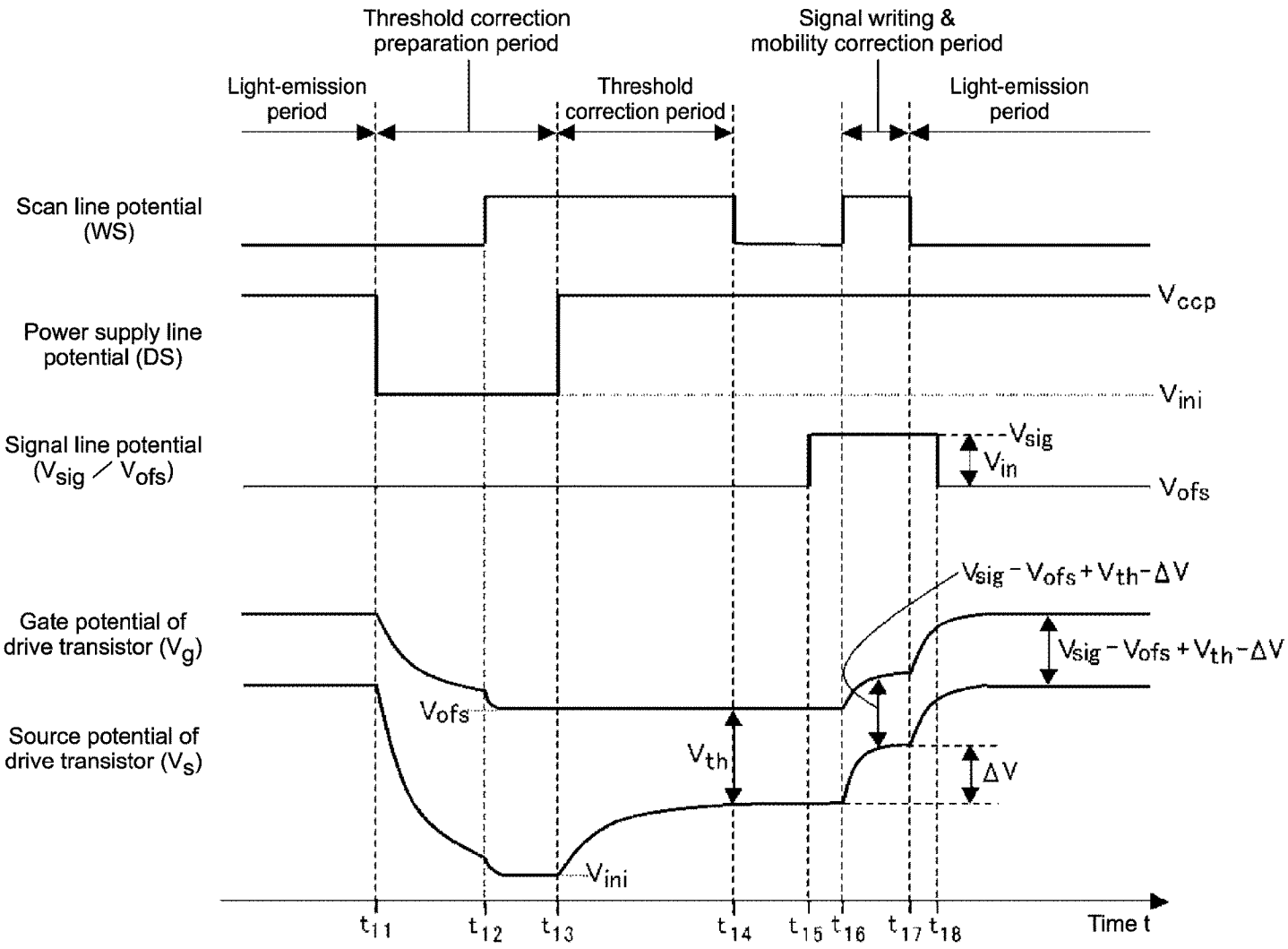
FIG. 3 is a timing waveform chart for describing an example of a basic circuit operation of the display apparatus.

According to the timing waveform chart of FIG. 3, a period before time $t_{11}$ is a light-emission period of the organic EL element 21, and this is a period in a previous display-frame. In this light-emission period in the previous display-frame, the potential DS of the power supply line 32 is at the first power potential (hereinafter referred to as "higher potential") $V_{ccp}$; and the write transistor 23 is in a non-conductive state.

The drive transistor 22 is designed to operate in the saturated region in this period. Therefore, the drive current (drain-source current) dependent upon a gate-source voltage $V_{gs}$ of the drive transistor 22 (see FIG. 2) is supplied to the organic EL element 21 from the power supply line 32 via the drive transistor 22. As a result, the organic EL element 21 emits light with a luminance (gradation) dependent upon the current value of the drive current.

At the time $t_{11}$, a new display-frame (present display-frame) of the line-sequential scanning starts, and the potential DS of the power supply line 32 is switched from the higher potential $V_{ccp}$ to the second power potential (hereinafter referred to as "lower potential") $V_{ini}$ that is sufficiently lower than $V_{ofs}-V_{th}$.

Under the definition that a threshold voltage of the organic EL element 21 is $V_{thel}$ and the potential of the common power supply line 34 (cathode potential) is $V_{cath}$, if the lower potential $V_{ini}$ is set to satisfy the relationship $V_{ini}<V_{thel}+V_{cath}$, the organic EL element 21 enters a reverse-bias state and thus the light emission thereof stops because the source potential $V_s$ of the drive transistor 22 becomes almost equal to the lower potential $V_{ini}$.

Subsequently, at time $t_{12}$, the potential WS of the scan line 31 is switched from around the lower potential toward the higher potential; and thus the write transistor 23 enters the conductive state. At this time, with the reference voltage $V_{ofs}$ being supplied from the signal output circuit 60 to the signal line 33, the gate potential $V_g$ of the drive transistor 22 becomes equal to the reference voltage $V_{ofs}$. The source potential $V_s$ of the drive transistor 22 becomes a potential sufficiently lower than the reference voltage $V_{ofs}$, that is, the lower potential $V_{ini}$.

At this time, the gate-source voltage $V_{gs}$ of the drive transistor 22 becomes $V_{ofs}-V_{ini}$. In order to perform the threshold correction processing which will be described later, the $V_{ofs}-V_{ini}$ needs to be larger than the threshold voltage $V_{th}$ of the drive transistor 22. Therefore, each potential is set to satisfy the relationship $V_{ofs}-V_{ini}>V_{th}$.

The processing in such a manner, of fixing (settling) the gate potential $V_g$ of the drive transistor 22 at the reference voltage $V_{ofs}$ and fixing the source potential $V_s$ at the lower potential $V_{ini}$ for initialization, is a processing before the threshold correction processing (threshold correction operation) which will be described later; and this is a processing of preparation (threshold correction preparation). Therefore, the reference voltage $V_{ofs}$ and the lower potential $V_{ini}$ respectively become equal to initialization potentials of the gate potential $V_g$ and the source potential $V_s$ of the drive transistor 22.

Then, at time $t_{13}$, upon switching of the potential DS of the power supply line 32 from the lower potential $V_{ini}$ to the higher potential $V_{ccp}$, the threshold correction processing is started under the state where the gate potential $V_g$ of the drive transistor 22 is maintained at the reference voltage $V_{ofs}$. That is, the source potential $V_s$ of the drive transistor 22 starts to rise toward a potential whose value is obtained from subtracting the threshold voltage $V_{th}$ from the gate potential $V_g$.

As used herein, the term "threshold correction processing" means the processing of changing the source potential $V_s$ toward the potential whose value is obtained from subtracting the threshold voltage $V_{th}$ of the drive transistor 22 from the initialization potential of $V_{ofs}$; using the initialization potential of $V_{ofs}$ of the gate potential $V_g$ of the drive transistor 22 as a reference. As the threshold correction processing goes on, eventually, the gate-source voltage $V_{gs}$ of the drive transistor 22 becomes converged to the threshold voltage $V_{th}$ of the drive transistor 22. This voltage equivalent to the threshold voltage $V_{th}$ would be held in the holding capacitor 24.

Note that the potential $V_{cath}$ of the common power supply line 34 is set so that the organic EL element 21 is in a cut-off state in the period in which the threshold correction processing is performed (threshold correction period). Accordingly, the current from the drive transistor 22 flows toward the holding capacitor 24 but does not flow toward the organic EL element 21.

In such a manner, the threshold correction processing is performed from the time $t_{13}$ until time $t_{14}$. Therefore, the drain-source current supplied from the drive transistor 22 to the organic EL element 21 can have a value that does not depend on the threshold voltage $V_{th}$ of the drive transistor 22. As a result, it becomes possible to keep the light-emission luminance of the organic EL element 21 substantially constant; because the drain-source current has little or no variation, even in cases where the threshold voltage $V_{th}$ of the drive transistor 22 varies for each pixel due to the variability of the manufacturing process, time degradation of the drive transistor 22, or the like.

Subsequently, at the time $t_{14}$, the potential WS of the scan line 31 is switched toward the lower potential; and thus the write transistor 23 enters the non-conductive state. At this time, the gate of the drive transistor 22 becomes a floating state by being electrically disconnected from the signal line 33. However, with the gate-source voltage $V_{gs}$ being equal to the threshold voltage $V_{th}$ of the drive transistor 22, the drive transistor 22 is in the cut-off state. Therefore, the drain-source current does not flow in the drive transistor 22.

Then, at time $t_{15}$, the potential of the signal line 33 is switched from the reference voltage $V_{ofs}$ to the signal voltage $V_{sig}$ corresponding to the video signal. Subsequently, at time $t_{16}$, the potential WS of the scan line 31 is switched toward the higher potential; and thus the write transistor 23 enters the conductive state, to allow the signal voltage $V_{sig}$ corresponding to the video signal to be sampled and written in the pixel 20.

Due to the writing of the signal voltage $V_{sig}$ by the write transistor 23, the gate potential $V_g$ of the drive transistor 22 becomes the signal voltage $V_{sig}$. In driving of the drive transistor 22 by the signal voltage $V_{sig}$ corresponding to the video signal, the threshold voltage $V_{th}$ of the drive transistor 22 and the voltage that is held in the holding capacitor 24 and is equivalent to the threshold voltage $V_{th}$ cancel each other. Thus, the value of the drain-source current becomes a value that does not depend on the threshold voltage $V_{th}$.

At this time, the organic EL element 21 is in the cut-off state (high-impedance state). Therefore, the current (drain-source current) supplied from the power supply line 32 through the drive transistor 22 depending on the signal voltage $V_{sig}$ corresponding to the video signal flows into an equivalent capacitor of the organic EL element 21 and into the auxiliary capacitor 25. Thus, a charging of the equivalent capacitor of the organic EL element 21 and the auxiliary capacitor 25 is started.

Due to the charging of the equivalent capacitor of the organic EL element 21 and the auxiliary capacitor 25, the source potential $V_s$ of the drive transistor 22 rises up along with the elapse of time. At this time, a pixel-by-pixel variation in the threshold voltage $V_{th}$ of the drive transistor 22 has been cancelled, and the drain-source current of the drive transistor 22 depends on a mobility μ of the drive transistor 22. Note that the mobility μ of the drive transistor 22 is a mobility of a semiconductor thin film which makes up a channel of the drive transistor 22.

Supposing that a ratio of the held voltage of $V_{gs}$ of the holding capacitor 24 to the signal voltage $V_{sig}$ corresponding to the video signal, which is a write gain G, is 1 (ideal value); a rise of the source voltage $V_s$ of the drive transistor 22 to $V_{ofs}-V_{th}+\Delta V$ gives the gate-source voltage $V_{gs}$ of the drive transistor 22 of $V_{sig}-V_{ofs}+V_{th}-\Delta V$.

That is, the rise of the source potential $V_s$ by the rise amount ΔV functions to subtract the potential ΔV from the voltage $(V_{sig}-V_{ofs}+V_{th})$ held in the holding capacitor 24. In other words, this potential rise functions to discharge the electric charges in the holding capacitor 24, which also means that the rise amount ΔV of the source potential $V_s$ would be equivalent to a negative feedback applied to the holding capacitor 24. Consequently, the rise amount ΔV of the source potential $V_s$ is equivalent to a feedback amount of the negative feedback.

By thus applying the negative feedback to the gate-source voltage $V_{gs}$ by the feedback amount ΔV that depends on the drain-source current flowing through the drive transistor 22, it is possible to cancel the dependency of the drain-source current of the drive transistor 22 on the mobility μ of the drive transistor 22. The processing of cancelling the dependency is a mobility correction processing which corrects a pixel-by-pixel variation in the mobility μ of the drive transistor 22. More specifically, a higher signal amplitude $V_{in}$ ($=V_{sig}-V_{ofs}$) of the signal written to the gate electrode of the drive transistor 22 makes the drain-source current larger, and thus also the absolute value of the feedback amount ΔV of the negative feedback larger. Therefore, the mobility correction processing dependent upon the light-emission luminance level can be carried out.

Subsequently, at time $t_{17}$, the potential WS of the scan line 31 is switched toward the lower potential; and thus the write transistor 23 enters the non-conductive state. Thus, the gate of the drive transistor 22 becomes the floating state by being electrically disconnected from the signal line 33.

Since there is the holding capacitor 24 connected between the gate and the source of the drive transistor 22, in cases where the gate electrode of the drive transistor 22 is in the floating state, the gate potential $V_g$ of the drive transistor 22 changes in linkage with a change in the source potential $V_s$ thereof. Such an operation of allowing the gate potential $V_g$ of the drive transistor 22 to change in linkage with the change in the source potential $V_s$ is a bootstrap operation by the holding capacitor 24.

The gate electrode of the drive transistor 22 enters the floating state, and at the same time, as the drain-source current of the drive transistor 22 starts to flow into the organic EL element 21, an anode potential of the organic EL element 21 rises with the current.

Then, when the anode potential of the organic EL element 21 exceeds $V_{thel}+V_{cath}$, the drive current starts to flow in the organic EL element 21; and the organic EL element 21 starts to emit light. In addition, the rise in the anode potential of the organic EL element 21 is equivalent to the rise in the source potential $V_s$ of the drive transistor 22. When the source potential $V_s$ of the drive transistor 22 thus rises, in linkage with this, the gate potential $V_g$ of the drive transistor 22 also rises due to the bootstrap operation by the holding capacitor 24.

At this time, supposing that the bootstrap gain is 1 (ideal value); the rise amount of the gate potential $V_g$ would be equal to the rise amount of the source potential $V_s$. Therefore, during the light-emission period, the gate-source voltage $V_{gs}$ of the drive transistor 22 is kept constant at $V_{sig}-V_{ofs}+V_{th}-\Delta V$. Then, at time $t_{18}$, the potential of the signal line 33 is switched from the signal voltage $V_{sig}$ corresponding to the video signal to the reference voltage $V_{ofs}$.

In the series of circuit operations described above, each processing operation of the threshold correction preparation, the threshold correction, the writing of the signal voltage $V_{sig}$ and the mobility correction is performed in one horizontal scanning period (1H). Further, the processing operations of the writing of the signal and the mobility correction are performed in parallel during the period of time $t_{16}$ to $t_{17}$.

(STC Driving)

Now, an STC driving method will be described. The STC driving method makes it possible to secure even longer threshold correction time. For example, in cases where the STC driving method described below is used, by using a signal processing method according to an embodiment of the present disclosure, it becomes possible to display images with high quality. However, as a matter of course, the embodiment is not limited to that applied to the STC driving method.

The STC driving method is to perform the above-described threshold correction and allow driving and light-emitting on a unit-by-unit basis, under the definition that a plurality of horizontal lines makes up one unit. Accordingly, by the STC driving method, the threshold correction is performed at a same timing to a plurality of horizontal pixel groups; each horizontal pixel group including some pixels commonly connected to the selecting line (scan line 31) for selecting a pixel to write the signal voltage $V_{sig}$ among the pixels 20, the pixels in the horizontal pixel group being arranged in a horizontal direction. By employing the STC driving method, it becomes possible to secure a sufficient threshold correction time.

Figure 4:
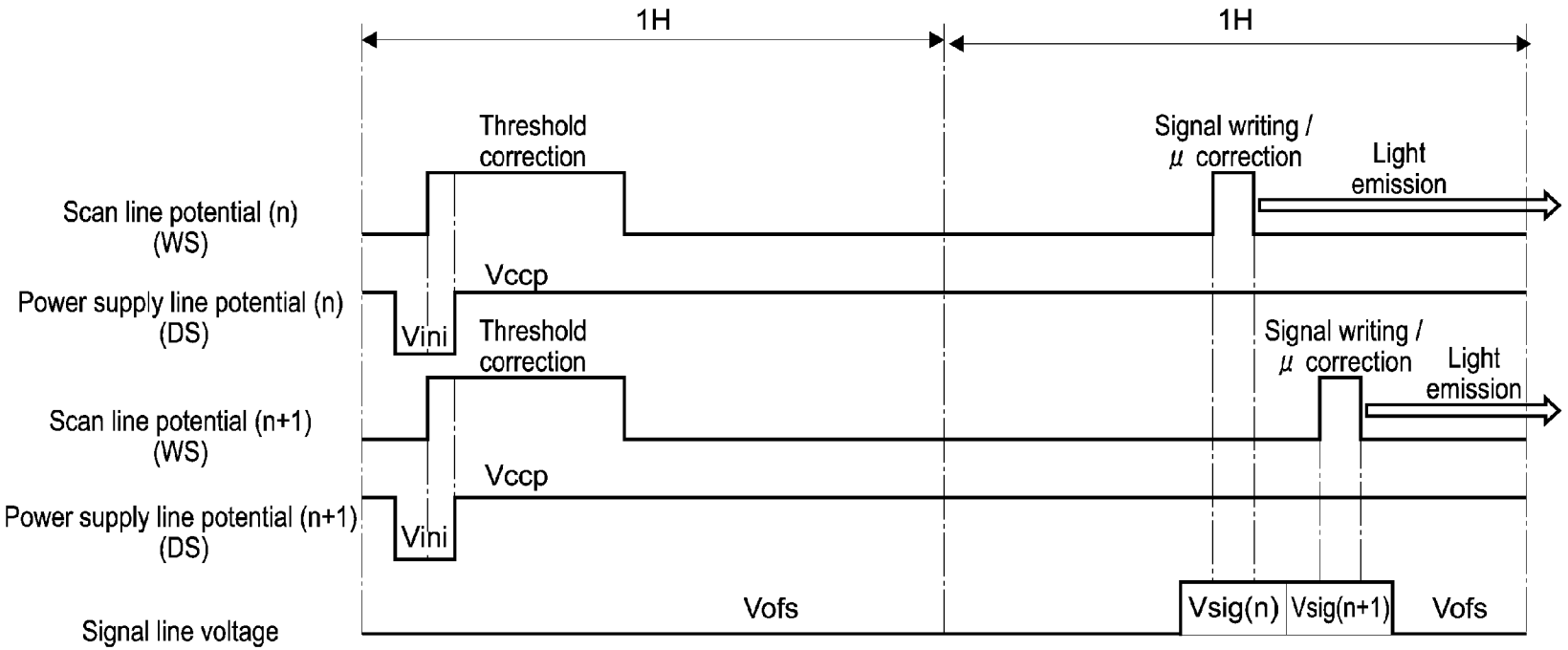
FIG. 4 is a schematic chart illustrating an example of a case where a circuit operation is performed by an STC driving method.

FIG. 4 is a schematic chart illustrating an example of a case where a circuit operation is performed by the STC driving method. In the example of the operation shown in FIG. 4, the threshold correction is performed on a unit-by-unit basis, with two horizontal lines included in one unit. The number of the horizontal lines included in one unit is not limited thereto.

In FIG. 4, a write scan signal WS(n) corresponding to a pixel of nth line; a power potential DS(n) corresponding thereto; a write scan signal WS(n+1) corresponding to a pixel of n+1th line; and a power potential DS(n+1) corresponding thereto are shown. To the signal line, the reference voltage $V_{ofs}$ and two signal voltages $V_{sig}$(n) and $V_{sig}$ (n+1) are output, during two horizontal scanning periods (2H). The period of 2H corresponds to the number of horizontal lines included in one unit.

As shown in FIG. 4, in the first horizontal scanning period, the threshold correction is performed at the same timing for the two horizontal lines. Then, in the next horizontal scanning period, the writing of the signal voltage $V_{sig}$ for each horizontal line is performed sequentially.

As shown in FIG. 4, to the signal line, the signal voltages $V_{sig}$(n) and $V_{sig}$(n+1), each setting a light-emission luminance of the organic EL element 21 included in the corresponding pixel, are output sequentially and continuously. At the same timing as that when the signal voltage $V_{sig}$(n) is given, the write scan signal WS(n) is set to high-level. This allows the writing of the signal voltage $V_{sig}$(n) and the mobility correction to be performed at the pixels 20 of the nth line, settles the gate-source voltage $V_{gs}$ thereof and makes them enter the light-emitting state.

Further, at the same timing as that when the signal voltage $V_{sig}$(n+1) is given, the write scan signal WS(n+1) is set to high-level. This allows the writing of the signal voltage $V_{sig}$(n+1) and the mobility correction to be performed at the pixels 20 of the n+1th line, settles the gate-source voltage $V_{gs}$ thereof and makes them enter the light-emitting state.

In such a manner, the STC driving method performs the threshold correction operation and the like for each unit at once, on a unit-by-unit basis. Performing the threshold correction for two lines means that: in one operation in which the signal voltage is the reference voltage $V_{ofs}$ for threshold correction/video signal $V_{sig}$, the period of 2H can be used. That is, it can take a long time for the threshold correction operation; and this driving method is thus effective in making operation margins larger, in response to an increase in the frame rate and an increase in pulse transient with an enlargement in panel size.

In cases where the STC driving method is employed, the signal output circuit 60 functions as a first output part to output the signal voltages $V_{sig}$ to the signal line 33 sequentially and continuously, each signal voltage $V_{sig}$ setting the light-emission luminance of the organic EL element 21, the signal line 33 being commonly connected to a plurality of predetermined pixels among the plurality of pixels 20.

(Video Signal Processor and Signal Processing Method)

Figure 5:
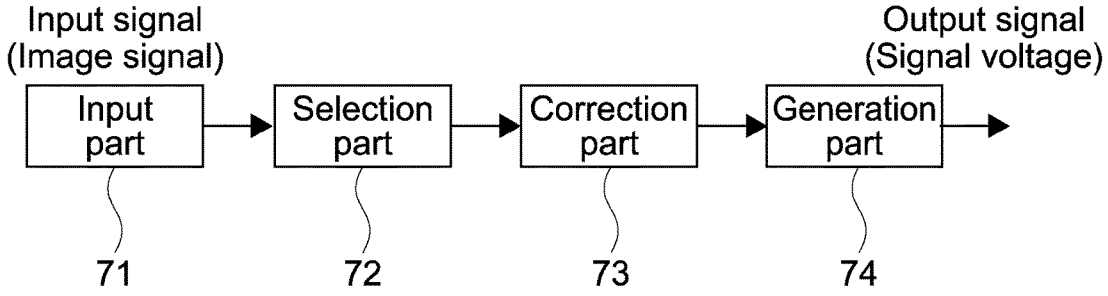
FIG. 5 is a schematic view showing a configuration example of a video signal processor.

FIG. 5 is a schematic view showing a configuration example of the video signal processor 70 of this embodiment. The video signal processor 70 includes an input part 71, a selection part 72, a correction part 73 and a generation part 74.

The input part 71 inputs image signals containing gradations of respective pixels of an image to be displayed. The selection part 72 selects corresponding gradations, which are the gradations contained in the input image signals and corresponding to respective common pixel circuits included in a plurality of common pixel circuits (hereinafter referred to as "common pixels"). The plurality of common pixels is a plurality of predetermined pixels 20, among the plurality of pixels 20, being commonly connected to the signal line 33, the signal voltages $V_{sig}$ being output to the signal line 33 sequentially and continuously, each signal voltage $V_{sig}$ setting a light-emission luminance of the organic EL element 21.

The plurality of predetermined pixels 20 commonly connected to the signal line 33, the signal voltages $V_{sig}$ being output to the signal line 33 sequentially and continuously, means the pixels 20 to which the respective signal voltages $V_{sig}(n)$ and $V_{sig}(n+1)$ are to be written as described in FIG. 4. That is, in this embodiment, the plurality of common pixels is the plurality of pixels 20 which is commonly connected to the signal line 33 and is arranged in a vertical direction, the pixels 20 being included in the plurality of horizontal pixel groups at which the threshold correction is performed at the same timing.

To describe it with reference to FIG. 1, among the plurality of pixels 20, the pixels 20 that are connected to the common signal line 33, arranged in the vertical direction, and are included in the same unit at which the threshold correction is to be performed at the same time, would serve as the plurality of common pixels. The selection part 72 selects, from the image signals that have been input, the gradations corresponding to the respective common pixels included in the plurality of common pixels.

The correction part 73 corrects levels of the respective corresponding gradations being selected corresponding to the plurality of common pixels, each on the basis of other corresponding gradations included in the plurality of corresponding gradations. The generation part 74 generates the signal voltages $V_{sig}$ according to the corrected corresponding gradations. In such a manner, this embodiment allows correcting the sizes of the respective signal voltages $V_{sig}$ in the plurality of signal voltages $V_{sig}$ being output to the signal line sequentially and continuously, by correcting the levels of the respective corresponding gradations.

The specific circuit configuration or the like of each block shown in FIG. 5 is not limited. Moreover, different blocks may be implemented as one block. Furthermore, each block may be implemented as a software block. That is, hardware of the display apparatus 10 and software stored in the storage 80 or the like may cooperate with each other to perform a signal processing method according to the present disclosure.

Note that examples of the gradations that can be used include, but are not limited to, 8-bit gradations of the levels from 0 to 255 and 10-bit gradations of the levels from 0 to 1023.

Figure 6:
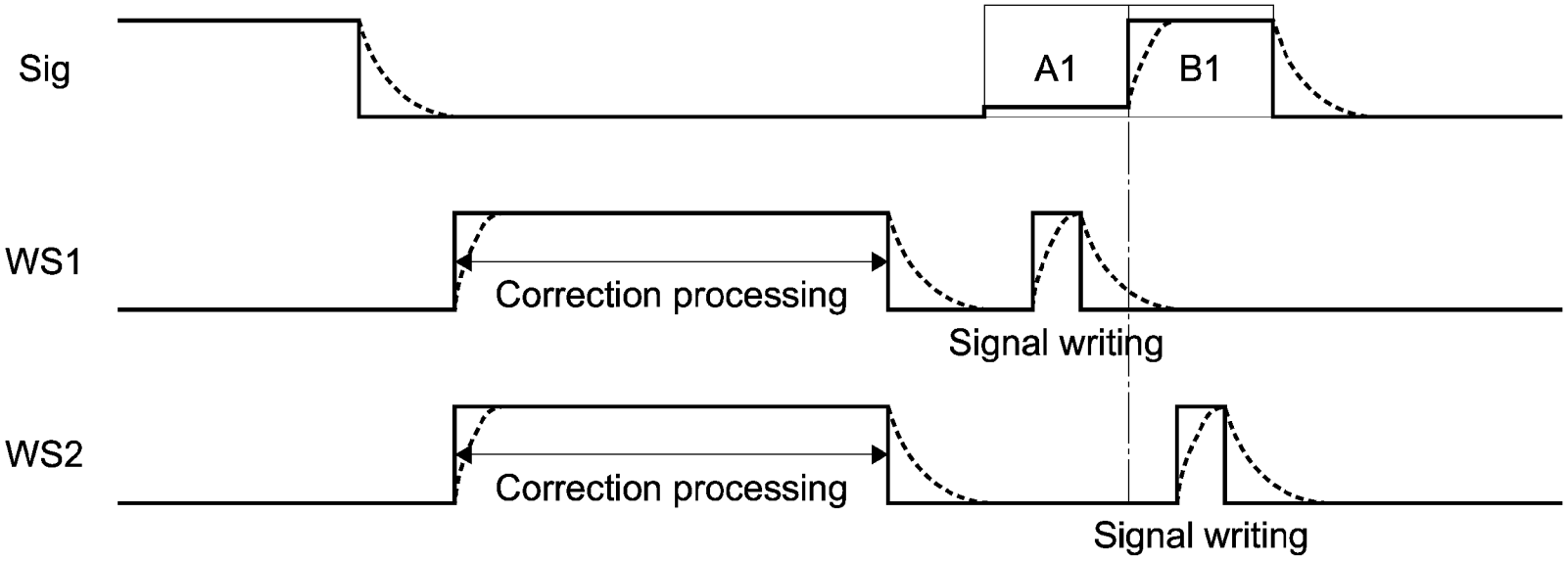
FIG. 6 is a schematic chart for describing a problem that might occur in the STC driving method.
Figure 7:
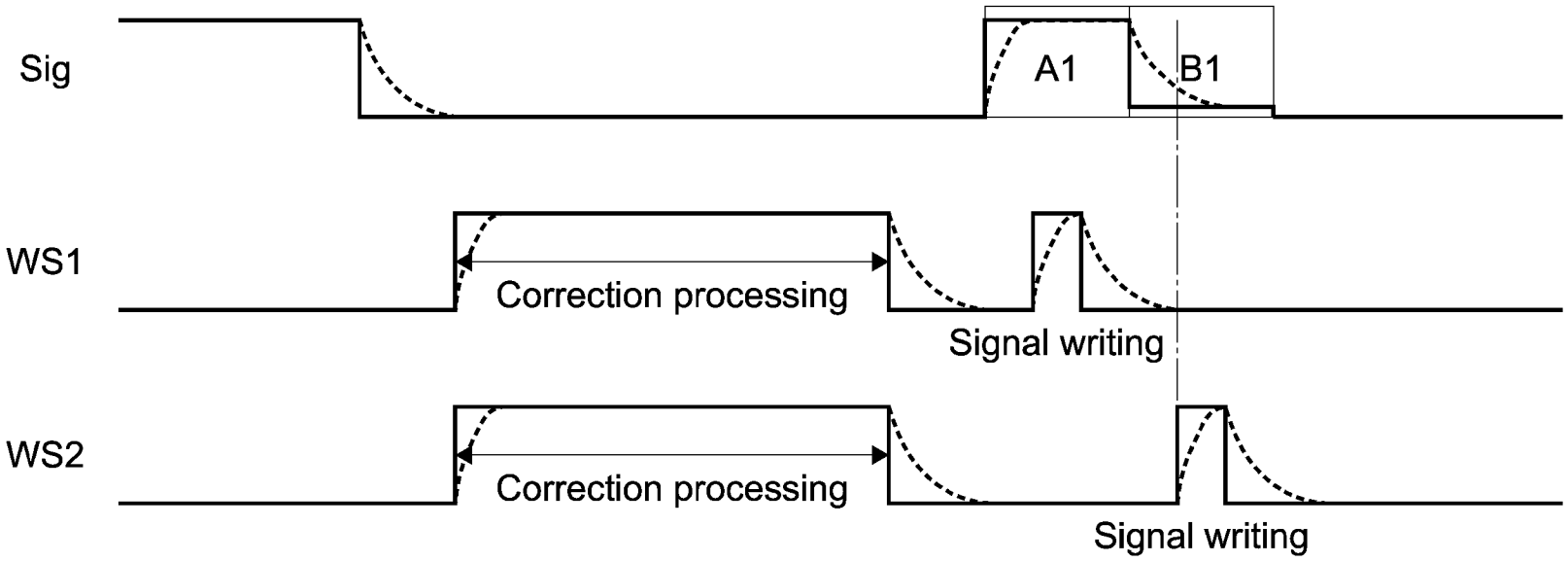
FIG. 7 is a schematic chart for describing a problem that might occur in the STC driving method.

FIGS. 6 and 7 are schematic charts for describing a problem that might occur in the use of the STC driving method. Hereinafter, as shown in FIGS. 6 and 7, two common pixels that are adjacent to each other will be denoted by alphabets, like "common pixels A1 and B1". The signal voltages to be input to these common pixels will be described as "signal voltages $V_{A1}$ and $V_{B1}$". The signal voltages $V_{A1}$ and $V_{B1}$ are output to the signal line 33 continuously in this order.

In addition, the signal line 33 will be described as "signal line Sig"; and the scan lines 31 each connected to the horizontal line will be described as "scan lines WS1 and WS2".

For example, there are some cases where a delay in a drive waveform occurs due to wiring resistance and parasitic capacitance. That is, as shown in FIGS. 6 and 7, a signal waveform of a pulse wave that is input as the signal voltage or the scan signal may be unsharpened in some cases. In such cases, the signal voltage that has been input may be written to an adjacent common pixel. This may result in an occurrence of a crosstalk, or the like.

In an example shown in FIG. 6, the signal voltage $V_{A1}$ is low-level and the signal voltage $V_{B1}$ is high-level. In this case, with the scan signal output to the signal line WS1 being unsharpened, the signal voltage $V_{B1}$ may be written to the common pixel A1 (the voltage value to be written may be pulled up by the high-level signal voltage $V_{B1}$).

In an example shown in FIG. 7, the signal voltage $V_{A1}$ is high-level and the signal voltage $V_{B1}$ is low-level. In this case, with the signal waveform being unsharpened when there is a change from the signal voltage $V_{A1}$ to the signal voltage $V_{B1}$, the signal voltage $V_{A1}$ may be written to the common pixel B1 (the voltage value to be written may be pulled up by the high-level signal voltage $V_{A1}$).

Further, in the example shown in FIG. 7, the voltage value to be written to the common pixel A1 may be pulled down by the low-level signal voltage $V_{B1}$. Besides, although not shown in FIG. 6, there is a probability that in the writing of the signal voltage $V_{B1}$ to the common pixel B1, the voltage value to be written may be pulled down by the low-level signal voltage $V_{A1}$.

In such a manner, there may be some cases where the writing of the signal voltage to the common pixel is affected by the signal voltage that is input to the adjacent common pixel. As a result, if the common pixels A1 and B1 emit light in the same color with each other, a crosstalk may occur and appear as horizontal stripes. If the common pixels A1 and B1 emit light in different colors from each other, a color-crosstalk in which the colors are mixed may occur. In either case, the quality of the displayed image would be deteriorated.

In order to prevent or reduce the effect of such a problem, a signal processing method according to the present disclosure may be performed. Hereinafter, some embodiments of the signal processing method will be described.

(Signal Processing Method 1)

Figures 8, 9:
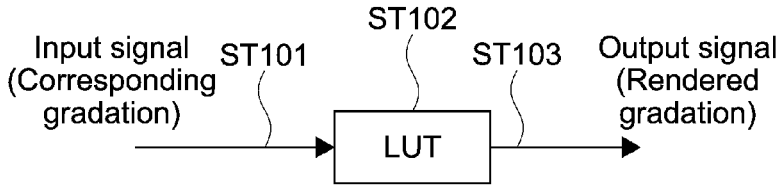
FIG. 8 is a flowchart showing an example of correction by a signal processing method according to the present disclosure.
FIG. 9 shows an example of a lookup table (LUT) used in a step of correcting.

FIG. 8 is a flowchart showing an example of correction by a signal processing method 1. Corresponding gradations which correspond to respective common pixels included in a plurality of common pixels (for example, A1 and B1) that has been selected by the selection part 72 are input (step 101). By the correction part 73, on the basis of a lookup table, levels of the respective corresponding gradations in the plurality of corresponding gradations are corrected, each on the basis of other corresponding gradations therein (step 102). The corrected corresponding gradations are output as rendered gradations for displaying an image (step 103).

A correction processing of step 102 will be described in detail. The signal voltages being output to the signal line sequentially and continuously are output in an order of arrangement of the plurality of common pixels. Under the definition that a corresponding gradation to be corrected is a target corresponding gradation, the target corresponding gradation would be corrected on the basis of a corresponding gradation that corresponds to an adjacent common pixel adjacent to a common pixel corresponding to the target corresponding gradation.

For example, regarding the examples shown in FIGS. 6 and 7, if the gradation corresponding to the common pixel A1 is the target corresponding gradation, the gradation would be corrected on the basis of the corresponding gradation that corresponds to the adjacent common pixel B1 adjacent to the common pixel A1 corresponding to the target corresponding gradation.

Under the definition that a corresponding gradation that corresponds to the adjacent common pixel is an adjacent corresponding gradation, the correction would be performed based on a magnitude relationship between the target corresponding gradation and the adjacent corresponding gradation. As has been described with reference to FIGS. 6 and 7, in cases where the adjacent corresponding gradation is higher than the target corresponding gradation, a voltage pulled up by the high-level signal voltage may be written. Consequently, to the common pixel corresponding to the target corresponding gradation, a signal voltage of a higher level than the desired level may be written. Accordingly, in the step of correcting, if the adjacent corresponding gradation is higher than the target corresponding gradation, the correction is performed in such a manner that the target corresponding gradation is decreased.

On the other hand, in cases where the adjacent corresponding gradation is lower than the target corresponding gradation, a voltage pulled down by the low-level signal voltage may be written. Consequently, to the common pixel corresponding to the target corresponding gradation, a signal voltage of a lower level than the desired level may be written. Accordingly, in the step of correcting, if the adjacent corresponding gradation is lower than the target corresponding gradation, the correction is performed in such a manner that the target corresponding gradation is increased. This allows sufficiently reducing an influence of a signal voltage that is adjacently output.

FIG. 9 shows an example of an LUT used in the step of correcting. This LUT stores the corrected value of the target corresponding gradation, taking the target corresponding gradation and the adjacent corresponding gradation as arguments. For the gradations which are not stored in the LUT, the corrected value thereof may be calculated by linear interpolation or the like. However, as a matter of course, it is also possible to store the corrected values for all of the gradations.

As shown in FIG. 9, in cases where the target corresponding gradation and the adjacent corresponding gradation have the same value with each other, the input target corresponding gradation would be output as it is. As described above, in cases where the adjacent corresponding gradation has a lower value, the target corresponding gradation may be corrected to be higher so as not to be pulled down by the lower value. On the other hand, in cases where the adjacent corresponding gradation has a higher value, the target corresponding gradation may be corrected to be lower so as not to be pulled up by the higher value. Each arrow in the LUT means that a value which satisfies the same condition as the value ahead of the arrow (for example, "value ≤64", etc.) is output as the corrected value. Note that, typically, the corrected value is set so that the amount of correction becomes larger as the difference between the target corresponding gradation and the adjacent corresponding gradation becomes larger.

According to the LUT of FIG. 9, in cases where the target corresponding gradation is a gradation of 0 (black), and also in cases where the target corresponding gradation is a maximum gradation of 1023 (white), the correction is not performed. This is because no gradations lower than 0 are set, and no gradations higher than 1023 are set. However, since other gradations are corrected as appropriate, it becomes possible to display images with high quality.

Whenever the target corresponding gradation is changed, different LUTs may be used, or the same LUT may be used in common. For example, depending on the order of the output of the signal voltages to the signal line (order of arrangement of the common pixels), colors of the light emitted by the common pixels, or the like, different LUTs may be used as appropriate.

The LUT may be created, as appropriate, depending on the configuration of each device and circuit of the display apparatus to be produced, specific examples of which include a resistance of the signal line, a parasitic capacitance value, a pixel design, the drive waveform, positions of pixels in a panel surface, and various conditions such as temperature. Typically, in is designing and producing the display apparatus, the LUT may be set and created for each series thereof. It is not limited thereto; and the LUT and the like may be created as appropriate when the product is shipped from a factory.

(Signal Processing Method 2)

Figures 10, 11:
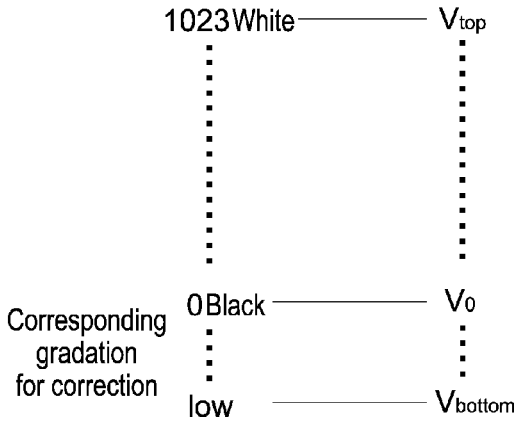
FIG. 10 schematically shows an association between each gradation and a corresponding voltage, for describing another example of correction by a signal processing method according to the present disclosure.
FIG. 11 shows an example of a LUT used in this example of correction.

FIG. 10 schematically shows an association between each gradation and a corresponding voltage, for describing an example of correction by a signal processing method 2. FIG. 11 shows an example of a LUT used in this example of correction.

In this example of correction, a correction voltage which is smaller than a zero signal voltage V0 is set. The zero signal voltage is a voltage which sets the light-emission luminance of the organic EL element 21 as a light-emitting element to zero. For example, there are some cases where the zero signal voltage, which sets the light-emission luminance to zero, is defined as the lowest voltage $V_{bottom}$; and the signal voltages corresponding to the respective gradations are set in a range from this voltage to the highest voltage $V_{top}$.

In contrast, in this example of correction, a voltage smaller than the zero signal voltage V0 is set as the lowest voltage $V_{bottom}$. The signal voltages in a range from the lowest voltage $V_{bottom}$ to the zero signal voltage V0 may be used as the correction voltages (including the lowest voltage $V_{bottom}$). The signal voltages corresponding to the respective gradations would be set in a range from the zero signal voltage V0 to the highest voltage $V_{top}$. Note that the zero signal voltage V0, typically, is set to the voltage value as that immediately before the start of the light-emission of the organic EL element 21.

By using such lowest voltage $V_{bottom}$ and the correction voltage, it becomes possible to perform the correction also in the case where the target corresponding gradation is the gradation of 0. Specifically, a gradation value for generating the lowest voltage $V_{bottom}$ and the correction voltage may be set. In the example shown in FIG. 10, the lowest voltage $V_{bottom}$ is generated corresponding to the gradation indicated by "low". In the range of from the gradation of "low" to that of 0, gradations for correction (including "low") for generating the voltages for correction may be set. The method of setting the gradations for correction is not limited. The gradations for correction may be set as appropriate in such a manner that they would be in an order corresponding to the magnitude relationship between voltages for correction; for example, as a value of a minus code, or the like.

As shown in the LUT of FIG. 11, in cases where the target corresponding gradation is the gradation of 0 and the adjacent corresponding gradation is larger than 0, the target corresponding gradation would be corrected to a gradation for correction at which the correction voltage smaller than the zero signal voltage V0 is generated. In this case as well, the amount of correction may become larger (make the corrected value of gradation smaller) as the difference between the target corresponding gradation and the adjacent corresponding gradation becomes larger. Such a signal processing may allow the correction with high accuracy.

(Signal Processing Method 3)

Figure 12:
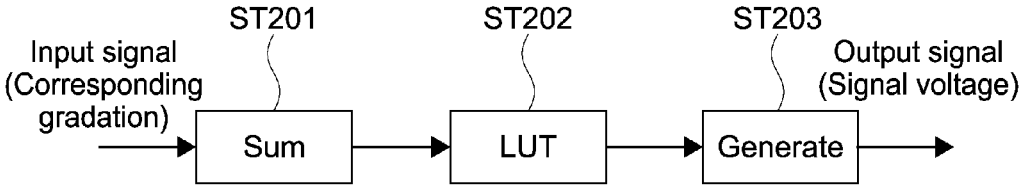
FIG. 12 is a flowchart describing still another example of correction by a signal processing method according to the present disclosure.
Figure 13:
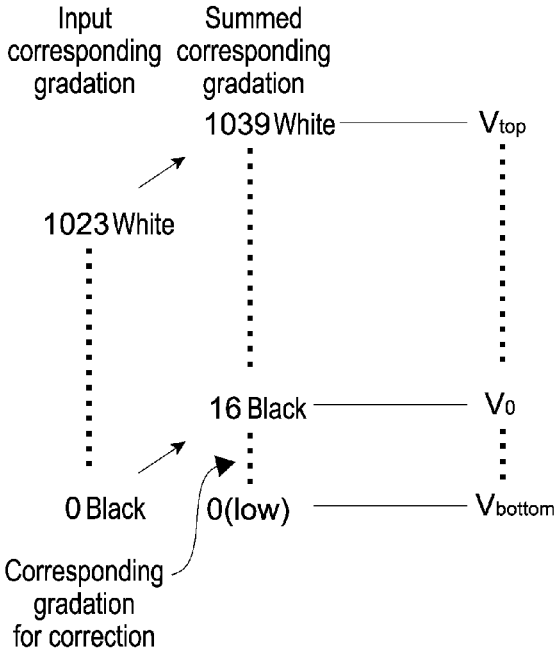
FIG. 13 schematically shows an association between each gradation and a corresponding voltage, for describing this example of correction.

FIG. 12 is a flowchart describing an example of correction by a signal processing method 3. FIG. 13 schematically shows an association between each gradation and a corresponding voltage.

In this example of correction, a plurality of summed corresponding gradations is generated by adding a predetermined value of gradation to each of the corresponding gradations in the plurality of corresponding gradations being selected (step 201). For example, as shown in FIG. 13, values obtained from adding the gradation of 16 to the corresponding gradations that have been input are generated as the summed corresponding gradations. By the correction part 73, levels of the respective summed corresponding gradations in the plurality of summed corresponding gradations are corrected, each on the basis of other summed corresponding gradations included in the plurality of summed corresponding gradations (step 202). In other words, the correction using the LUT, which is similar to the correction as described above, is performed with respect to the summed corresponding gradations.

By the generation part 74, signal voltages according to gradations obtained from subtracting the predetermined value from the corrected summed corresponding gradations are generated (step 203). In this example of correction, the gradation of 16 is subtracted as the predetermined value. That is, in this example of correction, in the step of generating the signal voltages according to the gradations, the signal voltages each for allowing the organic EL element 21 to emit light with the light-emission gradation obtained from subtracting the gradation of 16 from the gradations being input, in response to the gradations that has been input. As a result, the amount of gradation that has been added in the step of adding would be eventually cancelled; and thus the signal voltages according to the input gradations (including the corrected part when the gradation has been corrected) are generated.

When such a processing is performed, it becomes possible to use the gradations in a range from the gradation of 0 to a predetermined gradation (the gradation of 16, in this example). As a result, the gradation for correction may be easily set, without the need of newly setting a gradation for correction.

(Signal Processing Method 4)

Figures 14, 15:
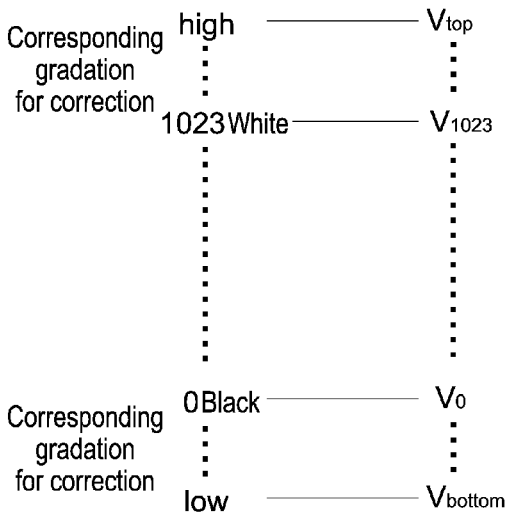
FIG. 14 schematically shows an association between each gradation and a corresponding voltage, for describing still another example of correction by a signal processing method according to the present disclosure.
FIG. 15 shows an example of a LUT used in this example of correction.

FIG. 14 schematically shows an association between each gradation and a corresponding voltage, for describing an example of correction by a signal processing method 4. FIG. 15 shows an example of a LUT used in this example of correction.

As shown in FIG. 14, the highest voltage $V_{top}$ may be set at a value larger than a highest signal voltage V1023. The highest signal voltage V1023 is a voltage which sets the light-emission gradation of the organic EL element 21 to a maximum gradation (the gradation of 1023, in this example). The signal voltages in a range from highest signal voltage V1023 to the highest voltage $V_{top}$ may be used as the correction voltages (including the highest voltage $V_{top}$). In this case, gradations for correction corresponding to these correction voltages may be set as appropriate in the range of higher levels than the gradation of 1023. As shown in FIG. 15, this may allow the correction also in cases where the target corresponding gradation is at the maximum gradation; and allow the correction with high accuracy.

As described above, with a signal processing method according to the present disclosure, it is possible to curb the problem that might occur due to the sequential and continuous output of the signal voltages $V_{sig}$ to the signal line 33. As a result, it becomes possible to prevent or reduce crosstalk that might be generated in various kinds of gradations. This makes it possible to display images with high quality.

Especially in cases where the STC driving method is used, since complicated pulses such as those for threshold correction may be used, a time interval between signal waveforms of a pixel and an adjacent pixel thereto is desired to be very short. Under such conditions, there are some cases where the waveforms are unsharpened due to wiring resistance and parasitic capacitance, which results in an occurrence of a crosstalk with the adjacent pixel. Such a problem may be more significant when the time for writing gets shorter in driving at high-resolution and high-frequency, and when the conditions of wiring resistance and parasitic capacitance gets worse by enlargement in size.

As has been described as the signal processing methods above, it is possible to curb the occurrence of the crosstalk by first measuring and calculating the corrected values based on the association of signal levels between a pixel and the adjacent pixel thereto from the viewpoint of pixel structure, and then applying the corrected values. As a result, it makes it possible to render vivid images, reducing the crosstalk such as a color crosstalk in which the colors are mixed.

Hereinafter, some examples of drive circuits to which a signal processing method of the present disclosure is applicable will be described.

Figure 16:
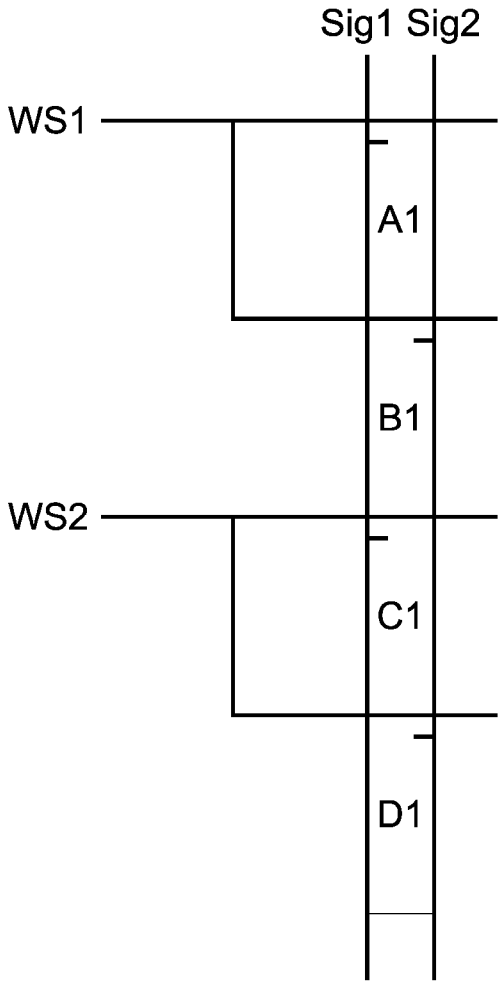
FIG. 16 is a schematic view showing an example of a drive circuit to which a signal processing method of the present disclosure is applicable.
Figure 17:
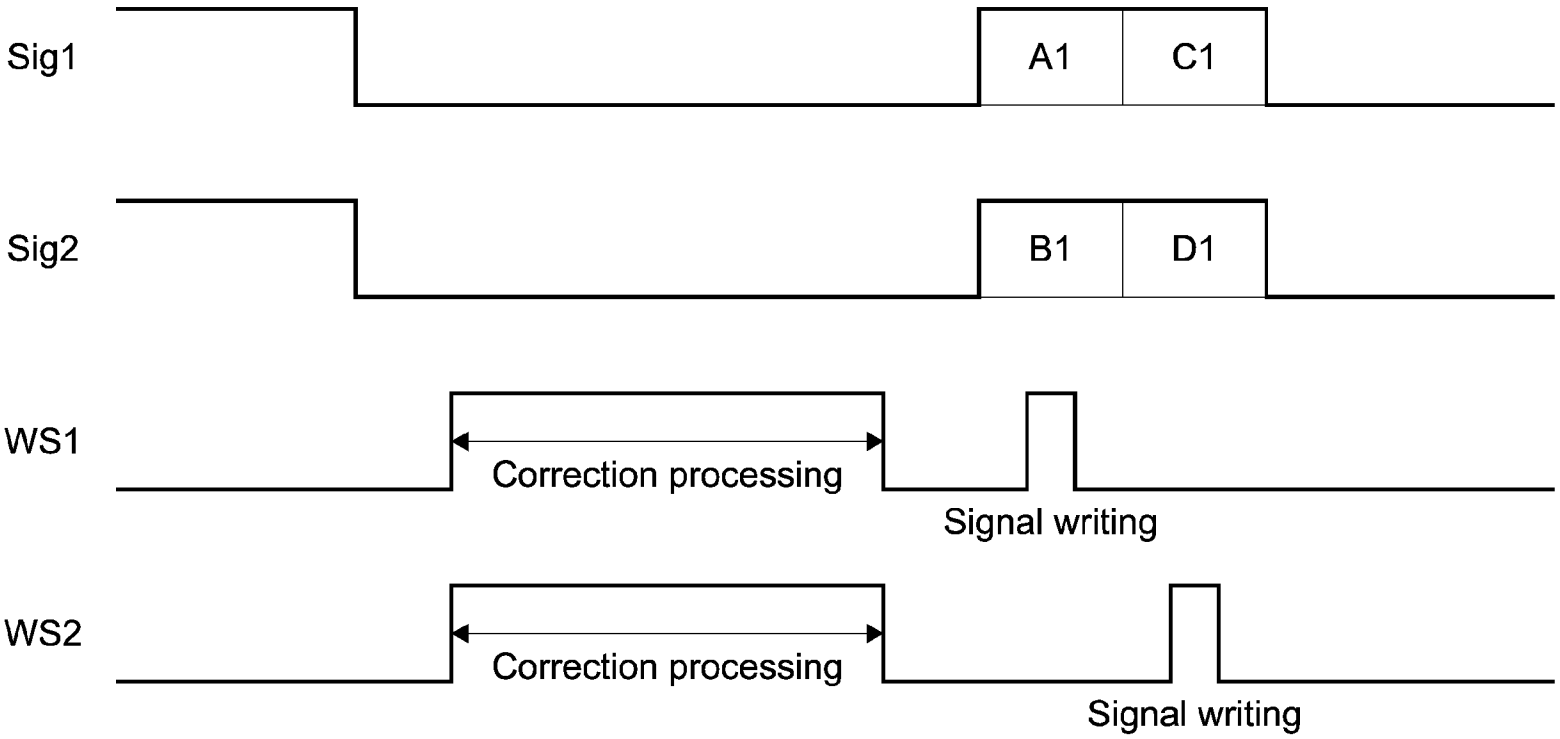
FIG. 17 is a schematic chart illustrating an example of a circuit operation of the drive circuit shown in FIG. 16.

FIG. 16 is a schematic view showing an example of a drive circuit. FIG. 17 is a schematic chart illustrating an example of a circuit operation of the drive circuit. In this drive circuit, four pixels A1, B1, C1 and D1 are arranged vertically. Among them, the pixels A1 and C1 are commonly connected to a signal line Sig1. The pixels B1 and D1 are commonly connected to a signal line Sig2. Further, a scan line SW1 is branched to be connected to the pixels A1 and B1. A scan line SW2 is branched to be connected to the pixels C1 and D1.

As shown in FIG. 17, in this example, the threshold correction is carried out with respect to the four horizontal lines at the same timing. Therefore, the horizontal pixel group is made up of these four horizontal lines. Among these pixels, the pixels A1 and C1 connected to the signal line Sig1 would serve as a plurality of common pixels. The pixels B1 and D1 connected to the signal line Sig2 would also serve as a plurality of common pixels.

Signal voltages A1 and C1 to be input to the pixels A1 and C1 are output sequentially and continuously to the signal line Sig1. Signal voltages B1 and D1 to be input to the pixels B1 and D1 are output sequentially and continuously to the signal line Sig2. A signal processing method according to the present disclosure may be applied when the signal voltages are output to each signal line.

Figure 18:
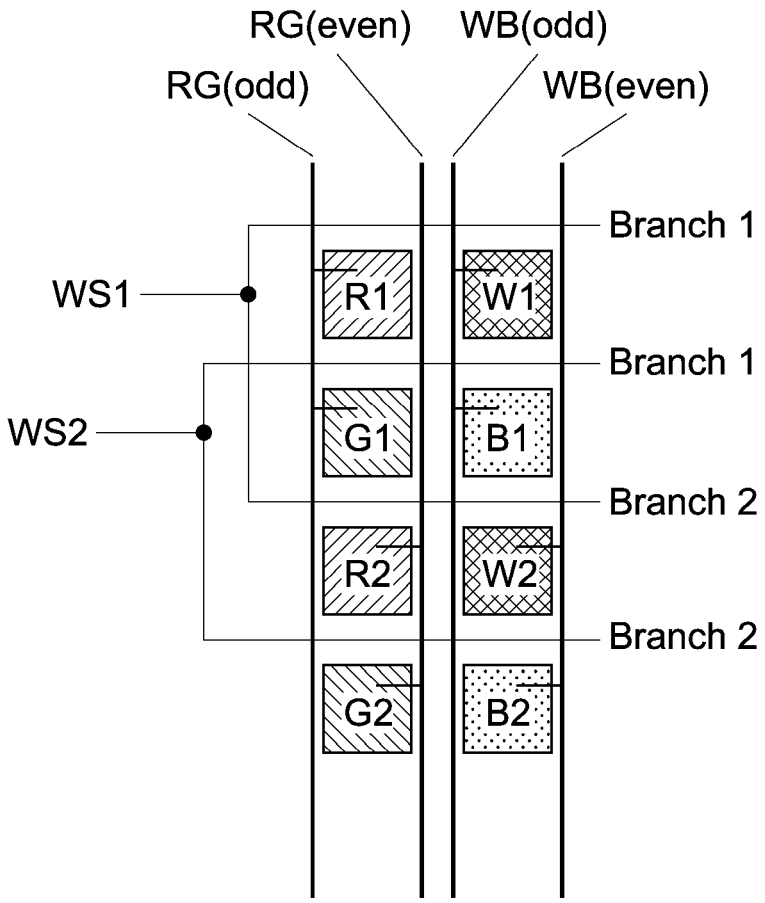
FIG. 18 is a schematic view showing an example of a drive circuit of a case where a color STC driving method is used.
Figure 19:
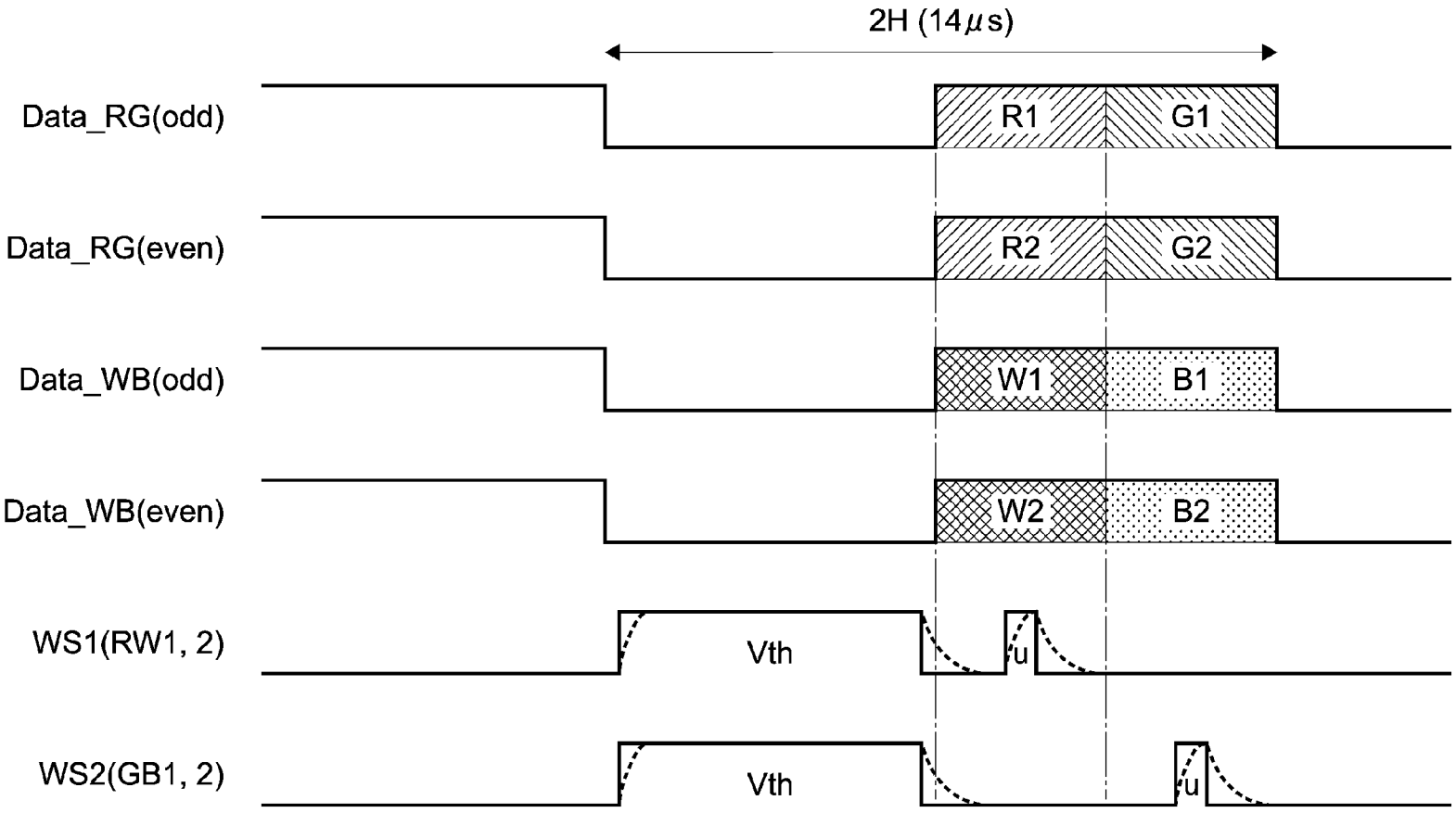
FIG. 19 is a schematic chart illustrating an example of a circuit operation of a case where a color STC driving method is used.

FIGS. 18 and 19 are schematic drawings showing an example of a drive circuit and an example of a circuit operation, of a case where a color STC driving method is used. The connections of each signal line and the pixels shown in FIG. 18 are as follows:

Signal line RG(odd) . . . Pixels R1 and G1 (forming a plurality of common pixels)

Signal line RG(even) . . . Pixels R2 and G2 (forming a plurality of common pixels)

Signal line WB(odd) . . . Pixels W1 and B1 (forming a plurality of common pixels)

Signal line WB(even) . . . Pixels W2 and B2 (forming a plurality of common pixels)

The connections of each scan line and the pixels are as follows:

Branch 1 of scan line WS1 . . . Pixels R1 and W1

Branch 2 of scan line WS1 . . . Pixels R2 and W2

Branch 1 of scan line WS2 . . . Pixels G1 and B1

Branch 2 of scan line WS2 . . . Pixels G2 and B2

As shown in FIG. 19, the threshold correction is carried out with respect to four horizontal lines at the same timing. Signal voltages for the pixels R1 and G1 are output sequentially and continuously to the signal line RG(odd). Signal voltages for the pixels R2 and G2 are output sequentially and continuously to the signal line RG(even). Signal voltages for the pixels W1 and B1 are output sequentially and continuously to the signal line WB(odd). Signal voltages for the pixels W2 and B2 are output sequentially and continuously to the signal line WB(even). The pixels having the same color out of the four colors of RGBW are subjected to write-control at the same timing; and thus an occurrence of stripes between the same-color pixels that have been arranged in the column direction is prevented.

In cases where such a color STC driving method is used, a signal processing method according to the present disclosure may be applied when the signal voltages are output to each signal line. As a result, it becomes possible to display images with high quality.

Figure 20:
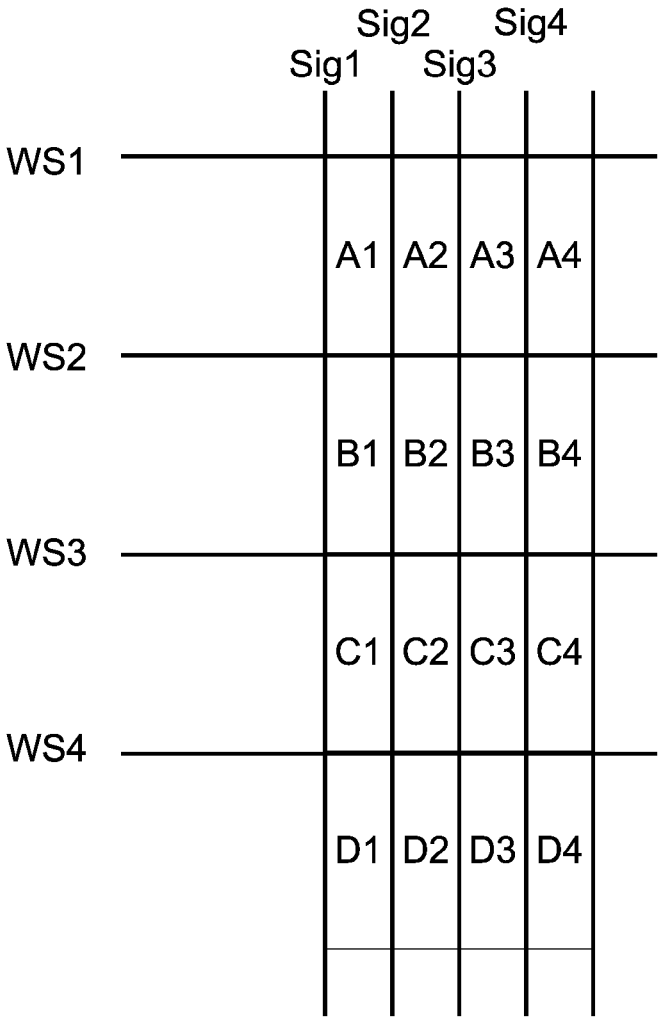
FIG. 20 is a schematic view showing an example of a drive circuit of a case where the number of common pixels is four, regarding a plurality of common pixels.
Figure 21:
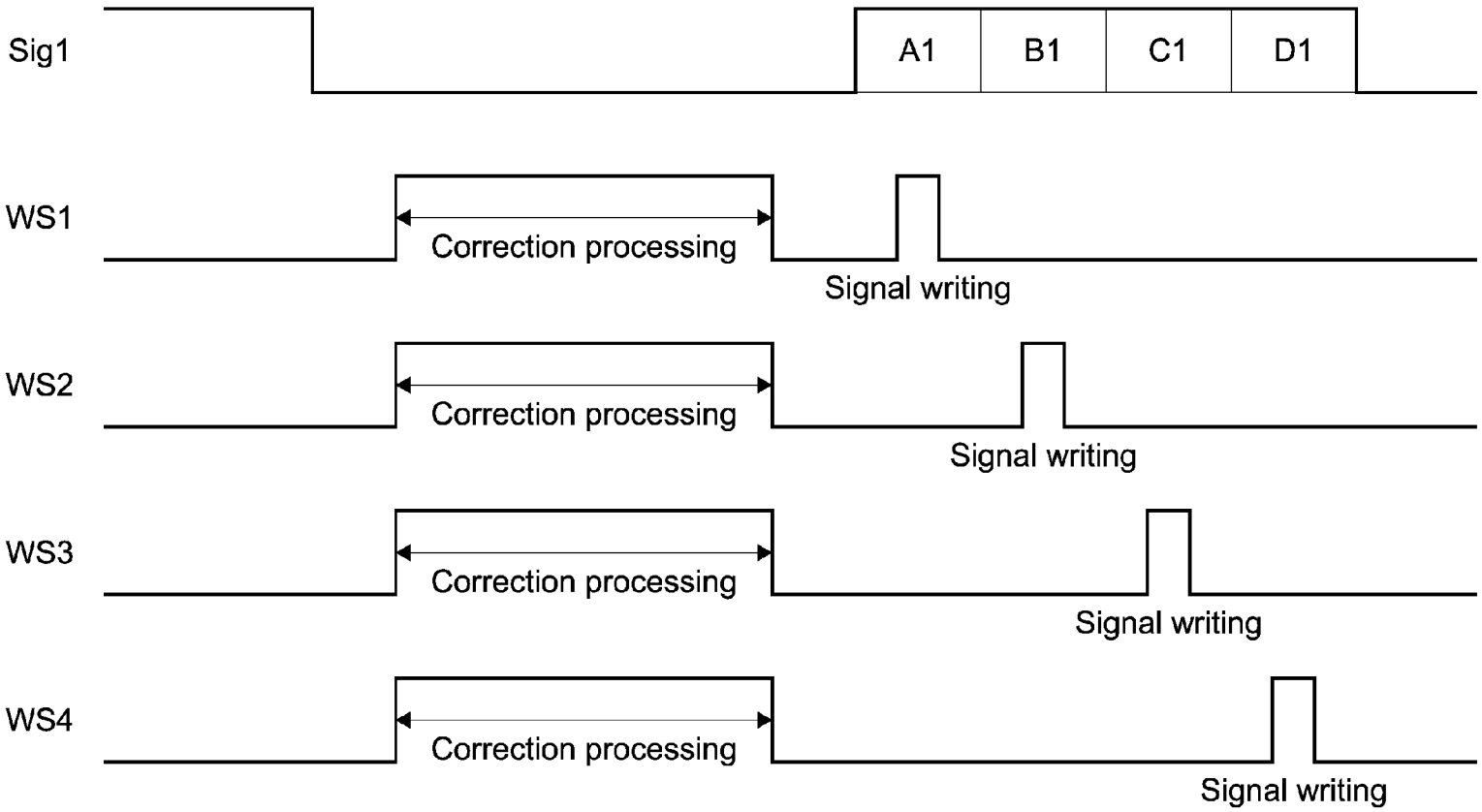
FIG. 21 is a schematic chart illustrating an example of a circuit operation of a case where the number of common pixels is four, regarding the plurality of common pixels.

FIGS. 20 and 21 are schematic drawings showing an example of a drive circuit and an example of a circuit operation of a case where the number of common pixels is four, regarding a plurality of common pixels. As shown in FIG. 20, among a plurality of pixels arranged in a matrix, each vertical line thereof is connected to the corresponding signal line Sig. Each horizontal line thereof is connected to the corresponding scan line WS. Each set of (An, Bn, Cn, Dn) (n denotes the same number) in FIG. 20 would serve as a plurality of common pixels.

FIG. 21 illustrates the signal voltages to be input to the plurality of common pixels A1, B1, C1 and D1, as a representative example. In such a case where three or more signal voltages are output sequentially and continuously, it is possible to apply a signal processing method according to the present disclosure as well. That is, the corresponding gradations corresponding to each common pixel in the plurality of common pixels A1, B1, C1 and D1 may be corrected based on other corresponding gradations.

Typically, the correction of the gradations may be performed based on a magnitude relationship between two values; which are the value of the target corresponding gradation to be corrected and the value of the adjacent corresponding gradation adjacent thereto, by using the LUT described in FIG. 9 or the like. For example, the following correction may be performed. Note that the corresponding gradation corresponding to each common pixel is denoted by using the same reference symbol as used for the common pixel (for example, the corresponding gradation corresponding to the common pixel A1 is described as "corresponding gradation A1").

The corresponding gradation A1 is corrected based on the corresponding gradations A1 and B1.

The corresponding gradation B1 is corrected based on the corresponding gradations A1 and B1.

The corresponding gradation C1 is corrected based on the corresponding gradations B1 and C1.

The corresponding gradation D1 is corrected based on the corresponding gradations C1 and D1.

In addition, the combination of two common pixels whose comparison is performed to obtain the magnitude relationship may be arbitrarily set. Moreover, the correction of gradations may be performed on the basis of three or more corresponding gradations as well. Thus, with any number of common pixels used as the plurality of common pixels, it is possible to display images with high quality by using a signal processing method according to the present disclosure.

(Electronic Apparatus)

The above-mentioned display apparatus may be incorporated into various electronic apparatuses as a module, for example. For example, an embodiment of the present disclosure can be applied to the smartphone shown in FIG. 22. A smartphone 200 includes a display part 210 and a non-display part 220, for example. The display part 210 includes the display apparatus according to the above-mentioned embodiment.

Moreover, an embodiment of the present disclosure can be applied to a television receiver shown in FIG. 23. A television receiver 300 includes a video display screen unit 300 including a front panel 310 and a filter glass 320, for example. The video display screen unit 300 includes the display apparatus according to the above-mentioned embodiment.

Examples of the electronic apparatus to which an embodiment of the present disclosure can be applied include a digital camera, a laptop personal computer, a portable terminal apparatus such as a mobile phone, and a video camera. In other words, the above-mentioned display apparatus can be applied to an electronic apparatus in any field, which displays, as an image or movie, a video signal input from the outside or a video signal generated therein.

Other Embodiments

The present disclosure is not limited to the embodiment described above; and various other embodiments can be devised.

In the above description, the correction of the plurality of signal voltages being output to the signal line sequentially and continuously has been performed by the processing including correcting levels of the respective corresponding gradations in the plurality of corresponding gradations. However, alternatively, it may be performed by the processing including generating the signal voltages according to the respective corresponding gradations in the plurality of corresponding gradations, and then correcting the sizes of the generated signal voltages. For example, a signal voltage generated based on a corresponding gradation before being corrected may be corrected as appropriate, in such a manner that the signal voltage becomes a signal voltage based on corresponding one of the corrected values of the corresponding gradations described in FIG. 9 or the like.

In the above description, the video signal processor has generated a signal voltage depending on an image signal, and the signal voltage has been supplied to a signal output circuit. However, an image signal including a corrected gradation may be supplied from the video signal processor to the signal output circuit. Then, the signal output circuit may generate a signal voltage depending on the image signal. In other words, the output part may be formed within the signal output circuit. In this case, a signal processing method according to the present disclosure would be implemented by the video signal processor and the signal output circuit.

As a signal processing method according to the present disclosure, the following method may be performed. That is, a first input image signal and a second input image signal may be input. The first input image signal corresponds to a first pixel connected to a predetermined signal line, and the second input image signal corresponds to a second pixel adjacent to the first pixel, the second pixel being connected to the predetermined signal line.

A first signal voltage supplied to the first pixel from the predetermined signal line in a first writing period is corrected based on the input second input image signal.

A second signal voltage supplied to the second pixel from the predetermined signal line in a second writing period is corrected based on the input first input image signal.

Now, to re-describe about the input image signal and the signal voltage, the input image signal is an input value indicating a gradation value described by classifying each color component of each pixel in a plurality of pixels that make up an image, to discrete values of, for example, 256 levels of 0 to 255. With the pixels each having the corresponding luminance based on the gradation value being rendered on the display part, the user is able to perceive the rendered image which is an assembly of the pixels. Note that the number of levels to classify the input image signal is not limited to 256, which may be smaller or greater than 256. Further, it is not limited to the input image signal input from the outside of the display apparatus. An image signal may be generated within the display apparatus, and the generated image signal may be used as the input value. Moreover, it is not limited to a digital value like the gradation value; and an analog value such as an amplitude voltage value of the signal may be used as well.

The signal voltage means a value of the voltage supplied via a signal line to a pixel circuit. A light-emission luminance of each pixel corresponding to the pixel circuit is determined according to the signal voltage. The light-emission luminance may be adjusted depending on a difference between signal voltages. For example, the higher the signal voltage is, the higher the light-emission luminance may become; or, the higher the signal voltage is, the lower the light-emission luminance may become.

Furthermore, the first and second pixel circuits may be the pixel circuits which emit light having different colors from each other, as shown in FIG. 18 and the like, for example. This signal processing method also makes it possible to display images with high quality.

In the above description, a case of using an STC driving method or a color STC driving method has been illustrated. However, the method is not limited thereto. In cases where a plurality of signal voltages is sequentially input and output to and from a signal line, an embodiment of the present disclosure would be applicable to any case, regardless of the driving method to be employed.

In the above description, the correction of the gradations has been performed by using the LUT. However, it is not limited thereto, and it may also use a method of multiplying the value by a predetermined coefficient and applying multiplication Gain, or a method of applying Offset to the value by adding or subtracting a predetermined value, for example.

In the above description, a display apparatus using an organic EL element has been illustrated. However, an embodiment of the present disclosure may also be applicable to other types of display apparatuses including other types of light-emitting elements such as inorganic EL elements.

It should be noted that the effects described herein are intended only for illustration and not limitation; and other effects may be produced. The above description of the plurality of effects does not necessarily imply that the effects are exerted at the same time. At least one of the above-mentioned effects may be obtained depending on conditions or the like. It goes without saying that effects that are not described herein may be exerted in some cases.

At least two feature parts of the embodiments described above can be combined. That is, a variety of feature parts that has been described in the explanation for each signal processing method may be arbitrarily combined.

Note that the present disclosure can take the following configurations.

(1) A signal processing method, including:

inputting image signals containing gradations of respective pixels of an image to be displayed;

selecting corresponding gradations, the corresponding gradations being the gradations contained in the input image signals and corresponding to respective common pixel circuits included in a plurality of common pixel circuits, the plurality of common pixel circuits being a plurality of predetermined pixel circuits among a plurality of pixel circuits each having a light-emitting element, the plurality of predetermined pixel circuits being commonly connected to a signal line, a plurality of signal voltages being output to the signal line sequentially and continuously, each signal voltage setting a light-emission luminance of the light-emitting element; and correcting sizes of the respective signal voltages in the plurality of signal voltages being output to the signal line sequentially and continuously, on the basis of a plurality of corresponding gradations selected corresponding to the plurality of common pixel circuits.

(2) The signal processing method according to (1), in which the correcting include correcting levels of the respective corresponding gradations in the plurality of corresponding gradations, each on the basis of other corresponding gradations included in the plurality of corresponding gradations, and then generating the signal voltages according to the corrected corresponding gradations.

(3) The signal processing method according to (1), in which the correcting includes generating the signal voltages according to the respective corresponding gradations in the plurality of corresponding gradations, and then correcting the sizes of the generated signal voltages.

(4) The signal processing method according to (2), in which the signal voltages according to the respective corresponding gradations in the plurality of corresponding gradations are output to the signal line sequentially and continuously in an order of arrangement of the plurality of common pixel circuits, and the correcting includes correcting a target corresponding gradation, on the basis of a corresponding gradation that corresponds to an adjacent common pixel circuit, the target corresponding gradation being a corresponding gradation in the corresponding gradations to be corrected, the adjacent common pixel circuit being adjacent to a common pixel circuit corresponding to the target corresponding gradation, among the common pixel circuits.

(5) The signal processing method according to (4), in which the correcting performs correction based on a magnitude relationship between the target corresponding gradation and an adjacent corresponding gradation, the adjacent corresponding gradation being the corresponding gradation that corresponds to the adjacent common pixel circuit.

(6) The signal processing method according to (5), in which the correcting includes, if the adjacent corresponding gradation is higher than the target corresponding gradation, decreasing the target corresponding gradation, and if the adjacent corresponding gradation is lower than the target corresponding gradation, increasing the target corresponding gradation.

(7) The signal processing method according to (6), in which if the target corresponding gradation is a gradation of zero and the adjacent corresponding gradation is higher than the gradation of zero, the correcting allows the target corresponding gradation to be corrected to a gradation for correction, the gradation for correction being a gradation at which a correction voltage smaller than a zero signal voltage is generated, the zero signal voltage being a voltage which sets the light-emission luminance of the light-emitting element to zero.

(8) The signal processing method according to (7), in which the correcting includes generating a plurality of summed corresponding gradations by adding a predetermined value of gradation to each of the corresponding gradations in the plurality of corresponding gradations being selected, and correcting levels of the respective summed corresponding gradations in the plurality of summed corresponding gradations being generated, each on the basis of other summed corresponding gradations included in the plurality of summed corresponding gradations, and wherein the signal processing method further includes generating the signal voltages according to gradations obtained from subtracting the predetermined value from the corrected summed corresponding gradations.

(9) The signal processing method according to (8), in which the lowest of the gradations is a gradation in a range of from the gradation of zero to the predetermined value of gradation.

(10) The signal processing method according to any one of (1) to (9), in which the plurality of pixel circuits is arranged in a matrix, each pixel circuit having a drive transistor configured to apply a drive current depending on the signal voltage to the light-emitting element, and the selecting includes selecting the corresponding gradations corresponding to the common pixel circuits in the plurality of common pixel circuits being commonly connected to the signal line and arranged in a vertical direction, the common pixel circuits being included in a plurality of horizontal pixel circuit groups at which a threshold correction is performed at a same timing, each horizontal pixel circuit group including pixel circuits commonly connected to a selecting line for selecting a pixel circuit to write the signal voltage, the pixel circuits being arranged in a horizontal direction, the threshold correction being performed to correct a gate-source voltage of the drive transistor based on a threshold voltage of the drive transistor.

It should be understood by those skilled in the art that various modifications, combinations, sub-combinations and alterations may occur depending on design requirements and other factors insofar as they are within the scope of the appended claims or the equivalents thereof.

What is claimed is:

1. A signal processing method, comprising:

inputting image signals containing gradations of respective pixels of an image to be displayed;

selecting corresponding gradations, the corresponding gradations being the gradations contained in the input image signals and corresponding to respective common pixel circuits included in a plurality of common pixel circuits, the plurality of common pixel circuits being a plurality of predetermined pixel circuits among a plurality of pixel circuits each having a light-emitting element, the plurality of predetermined pixel circuits being commonly connected to a signal line, a plurality of signal voltages being output to the signal line sequentially and continuously, each signal voltage setting a light-emission luminance of the light-emitting element;

correcting sizes of the respective signal voltages in the plurality of signal voltages being output to the signal line sequentially and continuously, on the basis of a plurality of corresponding gradations selected corresponding to the plurality of common pixel circuits; and correcting a target corresponding gradation, on the basis of a magnitude relationship between the target corresponding gradation and an adjacent corresponding gradation that corresponds to an adjacent common pixel circuit, the target corresponding gradation being a corresponding gradation in the plurality of corresponding gradations, the adjacent common pixel circuit being adjacent to a common pixel circuit corresponding to the target corresponding gradation, among the plurality of common pixel circuits, wherein when the target corresponding gradation is a gradation of zero and the adjacent corresponding gradation is higher than the gradation of zero, the correcting allows the target corresponding gradation to be corrected to a gradation for correction, the gradation for correction being a gradation at which a correction voltage smaller than a zero signal voltage is generated, the zero signal voltage being a voltage which sets the light-emission luminance of the light-emitting element to zero.

2. The signal processing method according to claim 1, wherein the correcting sizes of the respective signal voltages includes generating the signal voltages according to the corrected corresponding gradations.

3. The signal processing method according to claim 1, wherein the correcting sizes of the respective signal voltages includes generating the signal voltages according to the respective corresponding gradations in the plurality of corresponding gradations, and then correcting the sizes of the generated signal voltages.

4. The signal processing method according to claim 1, wherein the correcting includes, if the adjacent corresponding gradation is higher than the target corresponding gradation, decreasing the target corresponding gradation, and if the adjacent corresponding gradation is lower than the target corresponding gradation, increasing the target corresponding gradation.

5. The signal processing method according to claim 1, wherein the correcting a target corresponding gradation includes generating a plurality of summed corresponding gradations by adding a predetermined value of gradation to each of the corresponding gradations in the plurality of corresponding gradations being selected, and correcting levels of the respective summed corresponding gradations in the plurality of summed corresponding gradations being generated, each on the basis of other summed corresponding gradations included in the plurality of summed corresponding gradations, and wherein the signal processing method further includes generating the signal voltages according to gradations obtained from subtracting the predetermined value from the corrected summed corresponding gradations.

6. The signal processing method according to claim 5, wherein the lowest of the gradations is a gradation in a range of from the gradation of zero to the predetermined value of gradation.

7. The signal processing method according to claim 1, wherein the plurality of pixel circuits is arranged in a matrix, each pixel circuit having a drive transistor configured to apply a drive current depending on the signal voltage to the light-emitting element, and the selecting includes selecting the corresponding gradations corresponding to the common pixel circuits in the plurality of common pixel circuits being commonly connected to the signal line and arranged in a vertical direction, the common pixel circuits being included in a plurality of horizontal pixel circuit groups at which a threshold correction is performed at a same timing, each horizontal pixel circuit group including pixel circuits commonly connected to a selecting line for selecting a pixel circuit to write the signal voltage, the pixel circuits being arranged in a horizontal direction, the threshold correction being performed to correct a gate-source voltage of the drive transistor based on a threshold voltage of the drive transistor.

8. The signal processing method of claim 1, wherein when the target corresponding gradation is a gradation of maximum gradation and the adjacent corresponding gradation is lower than the gradation of maximum gradation, the correcting allows the target corresponding gradation to be corrected to a gradation for correction, the gradation for correction being a gradation at which a correction voltage larger than a highest signal voltage is generated, the highest signal voltage being a voltage which sets the light-emission luminance of the light-emitting element to a maximum gradation.

9. The signal processing method of claim 1, wherein the correcting the target corresponding gradation further comprises correcting the target corresponding gradation on the basis of a magnitude relationship between three or more corresponding gradations, including the target corresponding gradation and the adjacent corresponding gradation that corresponds to the adjacent common pixel circuit.

10. A display apparatus, comprising:

an input configured to input image signals containing gradations of respective pixels of an image to be displayed;

a plurality of pixel circuits each having a light-emitting element;

a first output configured to output a plurality of signal voltages to a signal line sequentially and continuously, each signal voltage setting a light-emission luminance of the light-emitting element, the signal line being commonly connected to a plurality of predetermined pixel circuits among the plurality of pixel circuits;

a selection part configured to select corresponding gradations, the corresponding gradations being the gradations contained in the input image signals and corresponding to respective common pixel circuits included in a plurality of common pixel circuits which is the plurality of predetermined pixel circuits; and a correction part being configured to correct sizes of the respective signal voltages in the plurality of signal voltages being output to the signal line sequentially and continuously, on the basis of a magnitude relationship between a target corresponding gradation and an adjacent corresponding gradation that corresponds to an adjacent common pixel circuit, the target corresponding gradation being a corresponding gradation in a plurality of corresponding gradations selected corresponding to the plurality of common pixel circuits, the adjacent common pixel circuit being adjacent to a common pixel circuit corresponding to the target corresponding gradation, among the plurality of common pixel circuits, wherein, when the target corresponding gradation is a gradation of zero and the adjacent corresponding gradation is higher than the gradation of zero, the correcting part allows the target corresponding gradation to be corrected to a gradation for correction, the gradation for correction being a gradation at which a correction voltage smaller than a zero signal is generated, the zero signal voltage being a voltage which sets the light emission luminance of the light emitting element to zero.

11. The display apparatus, according to claim 10, wherein the plurality of pixel circuits is arranged in a matrix, each pixel circuit having a drive transistor configured to apply a drive current depending on the signal voltage to the light-emitting element, and wherein the display apparatus further includes a second output configured to output to a selecting line a selecting signal for selecting a pixel circuit to write the signal voltage, the selecting line being connected commonly to a plurality of horizontal pixel circuits among the plurality of pixel circuits, the horizontal pixel circuits being the pixel circuits arranged in a horizontal direction, and wherein the plurality of common pixel circuits is arranged in a vertical direction and is included in a plurality of horizontal pixel circuit groups at which a threshold correction is performed at a same timing, each horizontal pixel circuit group including the plurality of horizontal pixel circuits commonly connected to the selecting line, the threshold correction being performed to correct a gate-source voltage of the drive transistor based on a threshold voltage of the drive transistor.

12. An electronic apparatus, comprising:

a display apparatus including an input configured to input image signals containing gradations of respective pixels of an image to be displayed, a plurality of pixel circuits each having a light-emitting element, a first output configured to output a plurality of signal voltages to a signal line sequentially and continuously, each signal voltage setting a light-emission luminance of the light-emitting element, the signal line being commonly connected to a plurality of predetermined pixel circuits among the plurality of pixel circuits, a selection part configured to select corresponding gradations, the corresponding gradations being the gradations contained in the input image signals and corresponding to respective common pixel circuits included in a plurality of common pixel circuits which is the plurality of predetermined pixel circuits, and a correction part being configured to correct sizes of the respective signal voltages in the plurality of signal voltages being output to the signal line sequentially and continuously, on the basis of a magnitude relationship between a target corresponding gradation and an adjacent corresponding gradation that corresponds to an adjacent common pixel circuit, the target corresponding gradation being a corresponding gradation in a plurality of corresponding gradations selected corresponding to the plurality of common pixel circuits, the adjacent common pixel circuit being adjacent to a common pixel circuit corresponding to the target corresponding gradation, among the plurality of common pixel circuits, wherein, when the target corresponding gradation is a gradation of zero and the adjacent corresponding gradation is higher than the gradation of zero, the correction part allows the target corresponding gradation to be corrected to a gradation for correction, the gradation for correction being a gradation at which a correction voltage smaller than a zero signal is generated, the zero signal voltage being a voltage which sets the light emission luminance of the light emitting element to zero.

* * * * *